US010215474B2

(12) United States Patent
Lim et al.

(10) Patent No.: US 10,215,474 B2
(45) Date of Patent: Feb. 26, 2019

(54) REFRIGERATOR

(71) Applicant: LG ELECTRONICS INC., Seoul (KR)

(72) Inventors: Jongwong Lim, Seoul (KR); Bonggun Jung, Seoul (KR); Siyoung Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/397,478

(22) Filed: Jan. 3, 2017

(65) Prior Publication Data

US 2017/0191742 A1 Jul. 6, 2017

(30) Foreign Application Priority Data

Jan. 4, 2016 (KR) ..... 10-2016-0000579

(51) Int. Cl.

| | |
|---|---|
| ***F25D 23/06*** | (2006.01) |
| ***A47B 88/407*** | (2017.01) |
| ***F25D 11/00*** | (2006.01) |
| ***F25D 25/02*** | (2006.01) |

(52) U.S. Cl.

CPC ..... *F25D 23/067* (2013.01); *A47B 88/407* (2017.01); *F25D 11/00* (2013.01); *F25D 23/066* (2013.01); *F25D 25/025* (2013.01); *A47B 2210/175* (2013.01); *F25D 2201/126* (2013.01)

(58) Field of Classification Search

CPC .... F25D 23/067; F25D 23/066; F25D 25/025; F25D 11/00; F25D 2201/126; A47B 88/407; A47B 2210/175

See application file for complete search history.

(56) References Cited

U.S. PATENT DOCUMENTS

| | | | | |
|---|---|---|---|---|
| 3,378,219 | A * | 4/1968 | Biesecker | F16B 23/021 211/123 |
| 5,361,599 | A * | 11/1994 | Dasher | A47B 57/42 312/407 |
| 5,893,620 | A * | 4/1999 | Birgelis | F25D 23/067 312/334.44 |
| 5,918,959 | A * | 7/1999 | Lee | F25D 25/025 312/330.1 |
| 7,240,980 | B2 * | 7/2007 | Koons | F25D 23/021 312/334.8 |
| 7,669,945 | B2 * | 3/2010 | Blersch | F25D 23/067 108/107 |
| 8,141,968 | B2 * | 3/2012 | Velarde | A47B 88/493 312/331 |
| 8,469,470 | B2 * | 6/2013 | Hecht | A47B 67/04 312/334.4 |
| 2003/0173882 | A1 * | 9/2003 | Koons | F25D 23/021 312/404 |

(Continued)

*Primary Examiner* — Hanh V Tran
(74) *Attorney, Agent, or Firm* — Fish & Richardson P.C.

(57) ABSTRACT

A refrigerator including an inner casing that is located within a main refrigerator body and that includes a storage compartment, and a mounting recess that is a recessed portion on a surface of the inner casing; and an in-refrigerator part that is configured to be coupled to the inner casing and that includes: a temporary fixing protrusion that protrudes from a portion of the in-refrigerator part and that includes two segments that are configured to (i) be inserted into the mounting recess, (ii) be coupled to an inner portion of the mounting recess, and (iii) be fixed to the mounting recess is disclosed.

20 Claims, 11 Drawing Sheets

(56) References Cited

U.S. PATENT DOCUMENTS

| | | | | |
|---|---|---|---|---|
| 2004/0104323 | A1* | 6/2004 | Hubert | F25D 25/02<br>248/250 |
| 2006/0232177 | A1* | 10/2006 | Filho | A47B 57/30<br>312/407 |
| 2007/0210089 | A1* | 9/2007 | Kauk | B29C 44/16<br>220/592.1 |
| 2010/0066228 | A1* | 3/2010 | Park | F25D 23/067<br>312/408 |
| 2014/0015394 | A1* | 1/2014 | Cha | B23P 15/26<br>312/404 |
| 2016/0123655 | A1* | 5/2016 | Chow | F25D 23/04<br>312/404 |

* cited by examiner

REFRIGERATOR

CROSS-REFERENCE TO RELATED APPLICATION

Pursuant to 35 U.S.C. § 119(a), this application claims the benefit of an earlier filing date of and the right of priority to Korean Application No. 10-2016-0000579, filed on Jan. 4, 2016, the contents of which are incorporated by reference herein in its entirety.

TECHNICAL FIELD

The present disclosure generally relates to a refrigerator including inner components that are temporarily fixed a storage compartment, and then, after a certain manufacturing process, permanently fixed to the storage compartment.

BACKGROUND

A refrigerator is an appliance for freezing or chilling foodstuffs and storing them in it. The refrigerator consists of a main refrigerator body with a food storage compartment in it and refrigeration cycle equipment for refrigeration. The refrigeration cycle equipment consists of a compressor, a condenser, an expander, and an evaporator. In general, a machine room is provided at the rear of the main refrigerator body, and the compressor and condenser of the refrigeration cycle equipment are installed in the machine room.

The main refrigerator body includes an outer casing forming the exterior of the refrigerator and an inner casing forming the wall of the food storage compartment. Insulation fills in the space between the outer casing and the inner casing. Insulation is made using a forming process.

SUMMARY

This specification describes technologies for a refrigerator.

In general, one innovative aspect of the subject matter described in this specification can be embodied in a refrigerator including: an inner casing that is located within a main refrigerator body and that includes a storage compartment, and a mounting recess that is a recessed portion on a surface of the inner casing; and an in-refrigerator part that is configured to be coupled to the inner casing and that includes: a temporary fixing protrusion that protrudes from a portion of the in-refrigerator part and that includes two segments that are configured to (i) be inserted into the mounting recess, (ii) be coupled to an inner portion of the mounting recess, and (iii) be fixed to the mounting recess.

The foregoing and other embodiments can each optionally include one or more of the following features, alone or in combination. In particular, one embodiment includes all the following features in combination. Each of the two segments of the temporary fixing protrusion includes: a respective contact portion that is configured to be coupled to the inner portion of the mounting recess, wherein the inner portion of the mounting recess includes: two pressure portions, each of the two pressure portions being configured to press a respective contact portion of the two contact portions, and wherein the two contact portions are configured to become closer when the two segments of the temporary fixing protrusion are inserted into the mounting recess. Based on a determination of whether the two segments of the temporary fixing protrusion are inserted into the mounting recess, a first distance between the two contact portions is longer than a second distance between the two pressure portions. Based on a determination of whether the two segments of the temporary fixing protrusion are inserted into the mounting recess, a difference between a first distance and a second distance is smaller than a third distance between the two segments, and wherein the first distance indicates a distance between the two contact portions and the second distance indicates a distance between the two pressure portions. The two segments of the temporary fixing protrusion include: a first projection, and a second projection that faces the first projection, and wherein each of the first projection and the second projection includes: a respective first portion that protrudes from the in-refrigerator part and that is spaced apart from the inner portion of the mounting recess, a respective second portion that is pressed by the inner portion of the mounting recess, a circumference of the respective second portion is larger than a circumference of the respective first portion, and a respective third portion that includes a first side and a second side, wherein a circumference of the respective third portion at the first side is larger than a circumference of the respective third portion at the second side. The two segments of the temporary fixing protrusion includes: a first projection, and a second projection that faces the first projection, wherein each of the first projection and the second projection includes: a respective first sloping portion that protrudes from the in-refrigerator part and that includes a first side and a second side, wherein a circumference of the respective first sloping portion at the first side is smaller than a circumference of the respective first sloping portion at the second side, and a respective second sloping portion that is coupled to the second side of the respective first sloping portion and that includes a third side and a fourth side, wherein a circumference of the respective second sloping portion at the third side is larger than a circumference of the respective second sloping portion at the fourth side, and wherein a respective boundary portion between the respective first sloping portion and the respective second sloping portion is configured to be pressed by the inner portion of the mounting recess. The in-refrigerator part includes: a base portion that is configured to support the temporary fixing protrusion, and through holes that connect a first side of the base portion to a second side of the base portion. The refrigerator further includes an outer casing that encloses the inner casing, and an insulation layer that is coupled between the outer casing and the inner casing and that is configured to block heat transfer from the inner casing to the outer casing. The mounting recess is configured to separate the storage compartment from the insulation layer. The mounting recess includes: a stepped portion that protrudes from a surface of the mounting recess, and wherein the temporary fixing protrusion includes: a bump that protrudes from the temporary fixing protrusion, and wherein the stepped portion is coupled to the bump when the temporary fixing protrusion is inserted into the mounting recess. The refrigerator further includes a drawer that is configured to store food and that is moveable between a first position and a second position, the drawer being inside the storage compartment at the first position and a part of the drawer being outside the storage compartment at the second position, wherein the in-refrigerator part includes: a sliding rail that is coupled to the inner casing and that is configured to guide the drawer. The sliding rail is coupled to a first of the drawer and includes a first temporary fixing protrusion that is configured to temporarily fix the sliding rail to the inner casing. The refrigerator further includes a vertical bar; and a bracket that couples the vertical bar to a surface of the inner casing and that is configured to divide the storage compartment into a first interior area and a second interior area, wherein the in-refrigerator part includes: bracket holders (i) that couple the bracket to the inner casing and (ii) that are configured to support the bracket, each of the bracket holders including a respective second temporary fixing protrusion that is configured to temporarily fix each of the bracket holders to the inner casing.

The subject matter described in this specification can be implemented in particular embodiments so as to realize one or more of the following advantages. A conventional insulation foaming process includes filling space between an outer casing of a refrigerator and an inner casing of the refrigerator with a liquid insulation material and transforming the liquid insulation material to a solid state by heating. However, the inner casing may include multiple holes for temporarily fixing in-refrigerator parts to the inner casing. When the liquid insulation material is filled in the space between the outer casing and the inner casing, the liquid insulation material can flow into a storage compartment through the holes. To prevent the flow of the liquid insulation material, the in-refrigerator parts include temporarily fixing protrusions and the inner case includes a mounting recess. The temporarily fixing protrusions temporarily couples the in-refrigerator parts to the inner casing, and then, blocks the flow of the liquid insulation material through the holes. Once the liquid insulation material becomes solid, the temporarily fixing protrusions is permanently fixed. Thus, the in-refrigerator parts can be permanently fixed to the inner casing.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like numbers and designations in the various drawings indicate like elements.

DETAILED DESCRIPTION

Figure 1:
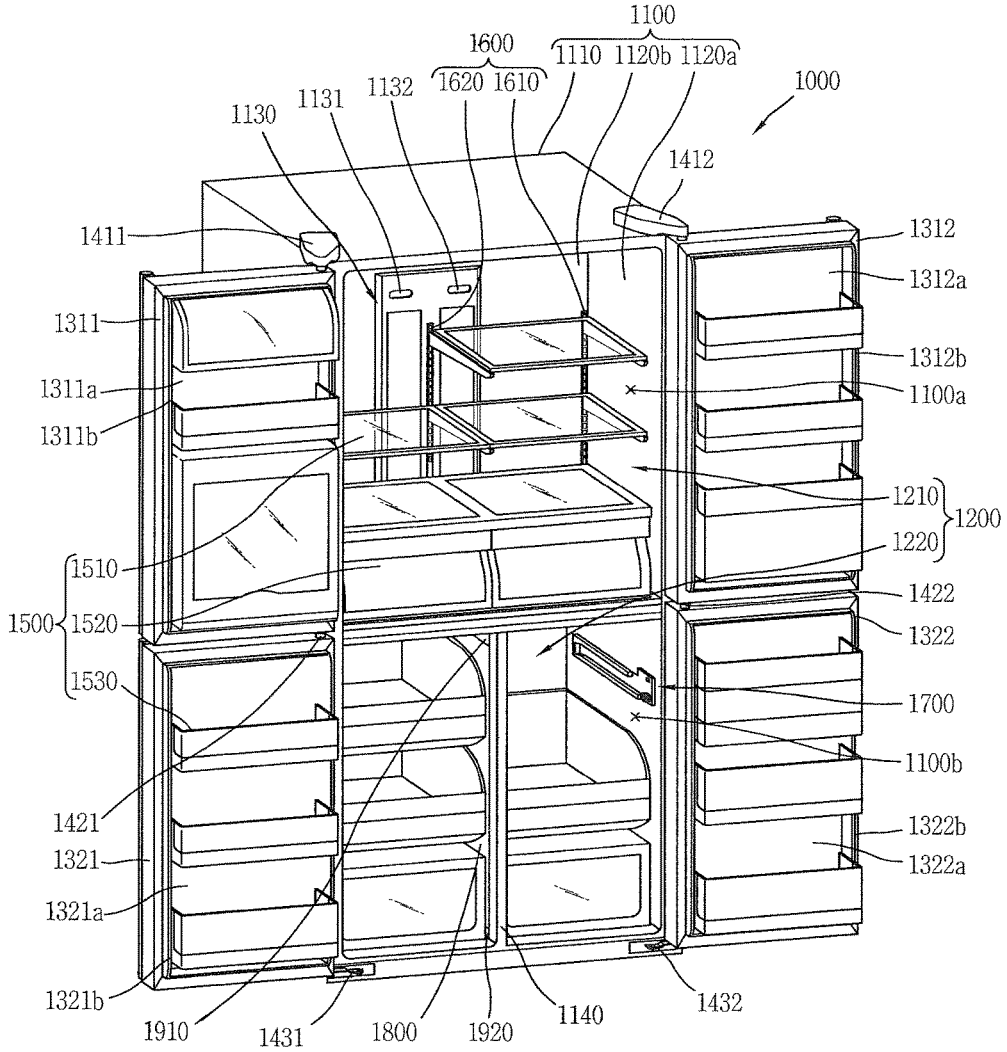
FIG. 1 is a diagram illustrating an example of a refrigerator.

FIG. 1 illustrates an example refrigerator.

The exterior of a refrigerator 1000 is formed by a main refrigerator body 1100 and doors 1311, 1312, 1321, and 1322. The main refrigerator body 1100 includes an outer casing 1110 and an inner casing 1120*a* and 1120*b*.

The outer casing 1110 forms the exterior of the refrigerator 1000 except the front of the refrigerator 1000 formed by the doors 1311, 1312, 1321, and 1322. The top and side of the refrigerator 1000 shown in FIG. 1 all correspond to the outer casing 1110.

The inner casing 1120*a* and 1120*b* is located within the main refrigerator body 1100. The inner casing 1120*a* and 1120*b* forms a food storage compartment 1200 in the refrigerator 1000. The food storage compartment 1200 may be divided into a chiller compartment 1210 and a freezer compartment 1220 based on temperature setting.

FIG. 1 shows a bottom freezer type refrigerator 1000 which has a chiller compartment 1210 provided in the upper part of the refrigerator 1100 and a freezer compartment 1220 provided in the lower part. However, the present disclosure is not necessarily limited to the bottom freezer type refrigerator 1000. This disclosure also may apply to a side-by-side type refrigerator with refrigerator and freezer compartments located on the left and right sides, a top mount type refrigerator with a freezer compartment located over a chiller compartment, and so on.

The inner casing 1120*a* and 1120*b* forms the inside walls of the food storage compartment 1200. The inner casing 1120*a* and 1120*b* may be divided based on position. For instance, FIG. 1 illustrates sidewalls 1120*a* and a back wall 1120*b*.

Although not shown in FIG. 1, insulation fills in the space between the outer casing 1110 and the inner casing 1120*a* and 1120*b*.

A duct structure 1130 for supplying cool air to the food storage compartment 1200 is attached to the back wall 1120*b*. The back of the food storage compartment 1200 is visually blocked by the back wall 1120*b* and the duct structure 1130. Since the duct structure 1130 forms a wall of the food storage compartment 1200 and its position corresponds to the back part of the food storage compartment 1200, the "back wall 1120*b*" may be understood to encompass the duct structure 1130 as well as the inner casing 1120*a* and 1120*b* in a broad sense.

A fan for supplying cool air to the food storage compartment 1200 is installed in the area visually blocked by the duct structure 1130. The duct structure 1130 forms a cool airflow path for supplying cool air from the fan to the food storage compartment 1200. Also, the duct structure 1130 has cool air outlets 1131 and 1132 that open towards the food storage compartment 1200. A flow of cool air caused by the fan flows along the cool airflow path of the duct structure 1130, and is supplied to the food storage compartment 1200 via the cool air outlets 1131 and 1132.

The doors 1311, 1312, 1321, and 1322 are connected to the main refrigerator body 1100, and form the exterior of the front of the refrigerator 1000. The doors 1311, 1312, 1321, and 1322 are configured to open or close front openings 1100*a* and 1100*b* of the refrigerator 1000. The front openings 1100*a* and 1100*b* of the main refrigerator body 1100 are an area for storing food in the food storage compartment 1200 or taking food out from the food storage compartment 1200. The doors 1311, 1312, 1321, and 1322 may be classified as swing doors or drawer-type doors. The swing doors are installed to swing on the main refrigerator body 1100, and the drawer-type doors are slidably connected to the main refrigerator body 1100.

The doors 1311, 1312, 1321, and 1322 may be classified based on installation position. Doors that open or close the chiller compartment 1210 may be classified as chiller compartment doors 1311 and 1312, and doors that open or close the freezer compartment 1220 may be classified as freezer compartment doors 1321 and 1322. Also, the doors 1311, 1312, 1321, and 1322 may be classified as a left chiller compartment door 1311, right chiller compartment door 1312, a left freezer compartment door 1321, and a right freezer compartment door 1322, respectively, depending on whether they are installed on the left or right side.

The doors 1311, 1312, 1321, and 1322 have door liners 1311*a*, 1312*a*, 1321*a* and 1322*a* on the inside, and gaskets 1311*b*, 1312*b*, 1321*b* and 1322*b* for preventing leakage of cool air are installed around the perimeters of the door liners 1311*a*, 1312*a*, 1321*a* and 1322*a*. The door liners 1311*a*, 1312*a*, 1321*a* and 1322*a*, along with baskets 1530 to be described later, form a storage space for food. The gaskets 1311*b*, 1312*b*, 1321*b* and 1322*b* are pressed tightly against the edges of the front openings 1100*a* and 1100*b* to seal the food storage compartment 1200.

FIG. 1 illustrates swing doors 1311, 1312, 1321, and 1322 which are installed to swing on the main refrigerator body 1100. The refrigerator 1000 has hinges 1411, 1412, 1421, 1422, 1431, and 1432 for allowing the swinging of the doors 1311, 1312, 1321, and 1322.

The hinges 1411, 1412, 1421, 1422, 1431, and 1432 are classified as upper hinges 1411 and 1412, middle hinges 1421 and 1422, and lower hinges 1431 and 1432 based on installation position. Referring to FIG. 1, the upper hinges 1411 and 1412 are installed on the top of the main refrigerator body 1100. The middle hinges 1421 and 1422 are installed between the chiller compartment doors 1311 and the freezer compartment doors 1321 and 1322. The lower hinges 1431 and 1432 are installed under the freezer compartment doors 1321 and 1322.

The upper hinges 1411 and 1412 and the middle hinges 1421 and 1422 are connected to the top and bottom of the chiller compartment doors 1311 and 1312, respectively, and allow the swinging of the chiller compartment doors 1311 and 1312. Also, the middle hinges 1421 and 1422 and the lower hinges 1431 and 1432 are connected to the top and bottom of the freezer compartment doors 1321 and 1322, respectively, and allow the swinging of the freezer compartment doors 1321 and 1322.

The refrigerator 1000 has at least one storage unit 1500 for efficient space utilization in the food storage compartment 1200. The storage unit 1500 is a concept that includes shelves 1510, trays 1520, and baskets 1530. The shelves 1510 and the trays 1520 may be installed in the food storage compartment 1200, and the baskets 1530 may be installed on the inside of the doors 1311, 1312, 1321, and 1322.

The shelves 1510 are shaped in the form of plates. The shelves 1510 are installed horizontally to the food storage compartment 1200 so as to place food on top of them. The shelves 1510 may be placed on shelf holders 1600 installed on the back wall 1120*b*.

The trays 1520 are configured to form a space separate from other parts of the food storage compartment 1200 and store food in it. The trays 1520 may be supported on the base of the inner casing 1120*a* and 1120*b*. The trays 1520 may be slide along the base of the inner casing 1120*a* and 1120*b*, sliding rails 1700, or sliding modules 5700 (see FIGS. 7A and 7B). The trays 1520 are also referred to as drawers.

The baskets 1530 form barriers that keep food from falling off the doors 1311, 1312, 1321, and 1322. The door liners 1311*a*, 1312*a*, 1321*a*, and 1322*a* are located on the inside of the doors 1311, 1312, 1321, and 1322, and the baskets 1530 are attached to the door liners 1311*a*, 1312*a*, 1321*a*, and 1322*a*. The door liners 1311*a*, 1312*a*, 1321*a*, and 1322*a* form a base and inside walls for storing food, and the baskets 1530 form outside walls.

The shelf holders 1600 are installed on the back wall 1120*b* of the food storage compartment 1200. As explained previously, the back wall 1120*b* of the food storage compartment 1200 is a concept that includes the duct structure 1130, as well as the back wall 1120*b* of the inner casing 1120*a* and 1120*b*. Thus, the shelf holders 1600 may be installed on the back wall 1120*b* of the inner casing 1120*a* and 1120*b* and the duct structure 1130. FIG. 1 illustrates both the shelf holders 1610 installed on the back wall 1120*b* of the inner casing 1120*a* and 1120*b* and the shelf holders 1620 installed on the duct structure 1130.

The shelf holders 1600 are configured to support the shelves 1510. The shelves 1510 are configured to be placed on the shelf holders 1600. Referring to FIG. 1, the shelf holders 1600 may be extended vertically. Therefore, multiple shelves 1510 may be placed vertically on a single shelf holder 1600. The shelves 1510 may be temporarily placed on the shelf holders 1600 by a worker, or be removed temporarily from the shelf holders 1600.

A vertical bar 1140 is installed at the front openings 1100*a* and 1100*b* of the food storage compartment 1200. The vertical bar 1140 is configured to extend vertically and divide the food storage compartment 1200 into left and right sections. FIG. 1 shows a configuration of the vertical bar 1140 installed at the front openings 1100*b* of the freezer compartment 1220.

The vertical bar 1140 is located between the left and right doors 1311, 1312, 1321, and 1322 to seal the gaps between the left and right doors 1311, 1312, 1321, and 1322. The vertical bar 1140 is provided to prevent leakage of cool air between the left and right doors 1311, 1312, 1321, and 1322.

A bracket 1800 is installed between the back of the vertical bar 1140 and the back wall 1120*b* of the inner casing 1120*a* and 1120*b*. The bracket 1800 is configured to divide the food storage compartment 1200 into left and right sections. The bracket 1800 will be described later with reference to FIG. 8.

A variety of in-refrigerator parts are installed in the food storage compartment 1200. The phrase "in-refrigerator" refers to the interior of the chiller compartment 1210 or freezer compartment 1220, and the phrase "in-refrigerator parts" refer to parts installed in the chiller compartment 1210 or freezer compartment 1220.

In some implementations, the in-refrigerator parts are installed to the inner casing 1120*a* and 1120*b*. Referring to FIG. 1, a sliding rail 1700 is installed on the sidewall 1120*a* of the freezer compartment 1220. The sliding rail 1700 allows for the sliding movement of the trays 1520, and may be installed on the inner casing 1120*a* and 1120*b* of the chiller compartment 1210, as well as on the freezer compartment 1220. Also, referring to FIG. 1, bracket holders 1910 and 1920, which are configured to support the top and bottom of the bracket 1800 that divide the to freezer compartment 1220 into left and right sections, are installed on the upper wall and base of the freezer compartment 1220, respectively.

In some implementations, the in-refrigerator parts include the shelves 1510, the trays 1520, and the baskets 1530. In some other implementations, the in-refrigerator parts include parts that are directly installed to the inner casings 1120*a* and 1120*b*. In some other implementations, the in-refrigerator parts include parts that are permanently fixed after they are temporarily fixed to the inner casings 1120*a* and 1120*b*.

The in-refrigerator parts that are directly installed to the inner casing 1120*a* and 1120*b* are permanently fixed after they are temporarily fixed. In particular, after the in-refrigerator parts are temporarily fixed, the insulation between the outer casing and the inner casing 1120*a* and 1120*b* is made using a forming process so that the in-refrigerator parts are permanently fixed.

The phrase "permanent fixing" refers to completely fixing the in-refrigerator parts to the inner casing 1120*a* and 1120*b*. For example, a special instrument can be necessary to remove the in-refrigerator parts that is permanently fixed to the inner casing 1120*a* and 1120*b*. The in-refrigerator parts permanently fixed to the inner casing 1120*a* and 1120*b* cannot be arbitrarily removed from the inner casing 1120*a* and 1120*b* unless they are intended to be removed by using a special instrument.

The phrase "temporary fixing" refers to temporarily fixing the in-refrigerator parts to the inner casing 1120*a* and 1120*b* before the permanent fixing in the refrigerator assembling process. The temporarily fixed in-refrigerator parts are not arbitrarily removed from the inner casing 1120*a* and 1120*b*. However, the permanent fixing is different from the temporary fixing in that the permanently fixed in-refrigerator parts can be easily removed from the inner casing 1120*a* and 1120*b* by the hands, without a special instrument, by applying external force.

If the in-refrigerator parts are simply installed or attached to the inner casing 1120*a* and 1120*b*, this may be interpreted as both the temporary fixing and the permanent fixing. On the other hand, if the in-refrigerator parts are installed or attached to the inner casing 1120*a* and 1120*b* once the assembling of the refrigerator 1000 is completed, this may be interpreted as only the permanent fixing in a strict sense.

Insulation foaming is the work of filling the space between the outer casing 1100 and the inner casing 1120*a* and 1120*b* with a raw liquid of insulation and transforming it from a liquid state to a solid state by heating. Other processes than the insulation foaming in the refrigerator assembling process consist mostly of the installation and attachment of mechanical and electronic parts, so the insulation foaming is distinct from other processes. In general, the in-refrigerator parts, in its narrower sense, are temporarily fixed to the inner casing 1120*a* and 1120*b* before the insulation foaming and permanently fixed to the inner casing 1120*a* and 1120*b* after completion of the insulation foaming.

Hereinafter, a temporary fixing structure of an in-refrigerator part that is temporarily fixed to the inner casing 1120*a* and 1120*b* will be described.

Figure 2A:
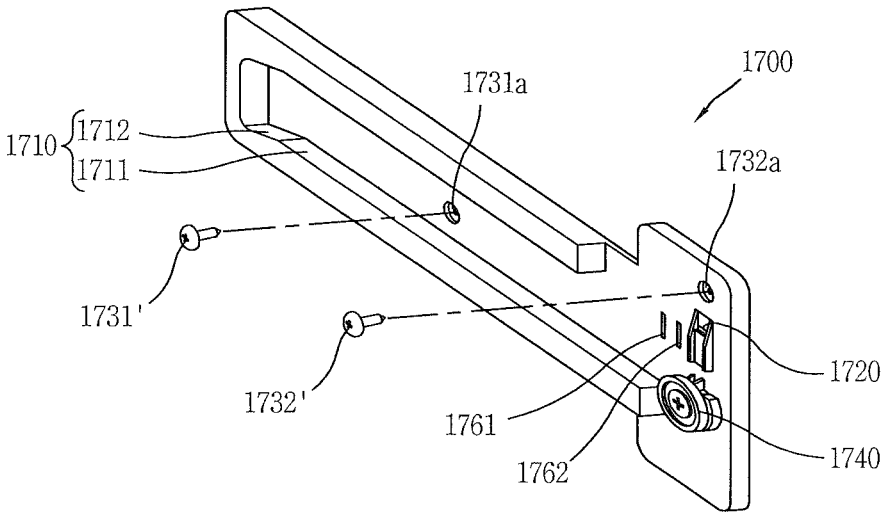
FIGS. 2A and 2B are diagrams illustrating an example sliding rail.
Figure 2B:
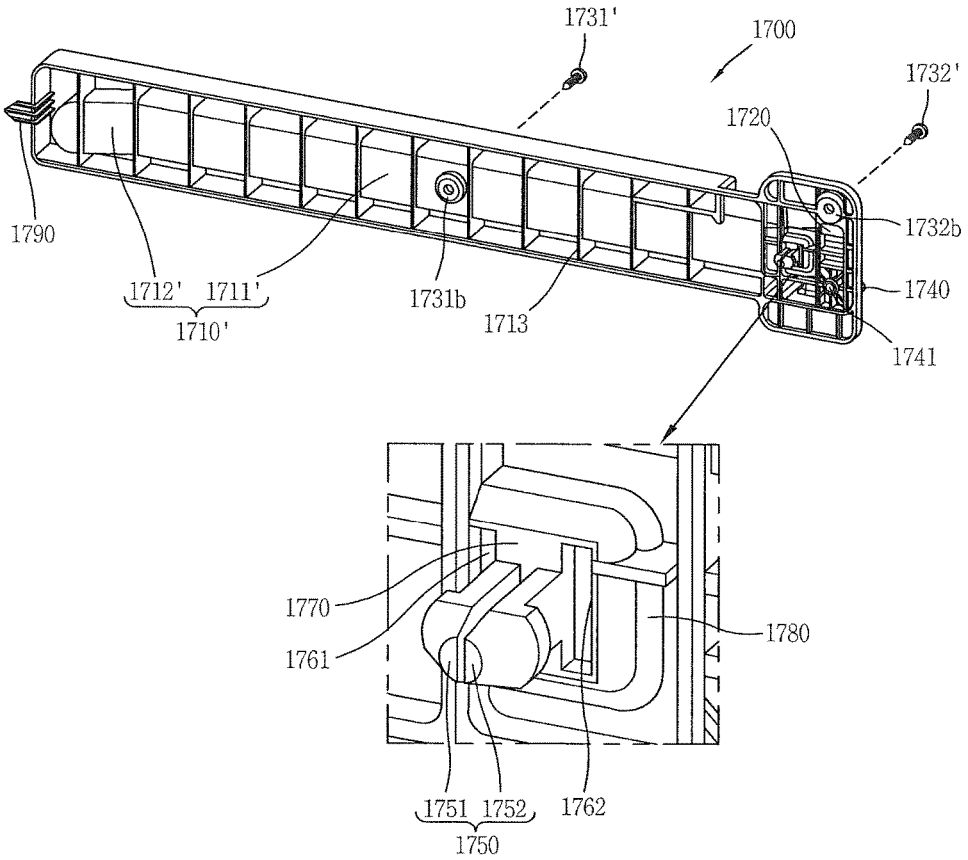

FIGS. 2A and 2B illustrate an example sliding rail. For example, the sliding rail 1700 of FIG. 1 can be a sliding rail in FIGS. 2A and 2B. FIG. 2A illustrates the sliding rail 1700 positioned to face the food storage compartment 1200. FIG. 2B illustrates the other side of the sliding rail 1700 positioned to face the inner casing 1120*a* and 1120*b* (see FIG. 1).

The sliding rail 1700 allows for the sliding movement of the trays 1520, drawers, or drawer-type doors. The sliding rail 1700 is temporarily fixed to the inner casing 1120*a* and 1120*b* (see FIG. 1), and then permanently fixed after insulation foaming. Therefore, the in-refrigerator part includes a sliding rail 1700 which guides the sliding movement of the trays 1520, drawers, or drawer-type doors. The sliding rail 1700 corresponds to the in-refrigerator part in their narrower sense.

The shape of the sliding rail 1700 may change depending on which among the trays 1520, drawers, and drawer-type doors they allow to slide. In this specification, components, such as the trays 1520, drawers, or drawer-type doors, which are configured to slide in the food storage compartment are referred to as sliders.

The sliding rail 1700 includes a rail portion 1710. The rail portion 1710 is formed on one side of the sliding rail 1700. The rail portion 1710 extends from the front of the food storage compartment 1200 (see FIG. 1) to the rear (or extends from the rear to the front). A roller is installed on the side of a slider, and the rail portion 1710 is configured to define a moving area for the roller. The perimeter of the rail portion 1710 protrudes, and the rail portion 1710 is recessed from the perimeter. The perimeter of the rail portion 1710 may be divided into an upper portion and a lower portion, and the upper portion may be shorter in length than the lower portion, for insertion of a roller 1740.

The rail portion 1710 has a horizontal rail portion 1711 extending along a straight line from the front of the food storage compartment 1200 (see FIG. 1) to the rear and a sloping rail portion 1712 at the back extending down diagonally at a predetermined angle. This is for preventing the slider from arbitrarily sliding out of the food storage compartment 1200 (see FIG. 1). When the roller of the slider is mounted on the diagonally-extending, sloping rail portion 1712, the slider is fully inserted in the food storage compartment 1200 (see FIG. 1). Also, the slider does not move laterally unless the slider is pulled intentionally with external force.

The roller of the slider is mounted on the rail portion 1710, and rotates with the rail portion 1710. When the roller of the slider rotates, the slider may slide into or out of the food storage compartment 1200 (see FIG. 1).

The sliding rail 1700 too has a roller 1740. The roller 1740 of the sliding rail 1700 is installed on one side of the sliding rail 1700, and located at the entrance of the rail portion 1710. The slider has a sliding surface corresponding to the roller 1740 of the sliding rail 1700. When the roller of the slider rotates within the rail portion 1710, the sliding surface slides while placed on the sliding rail 1700.

The sliding rail 1700 has a rotation axis support 1741. The rotation axis support 1741 is positioned radially with respect to the rotation axis of the roller 1740. The rotation axis of the roller 1740 extends towards the roller 1740 from the center of the rotation axis support 1741. The roller 1740 is attached in such a way as to be rotatable on the rotation axis, and rotates on the rotation axis.

A deformation preventing portion 1713 is formed on the other side of the sliding rail 1700. The deformation preventing portion 1713 is formed in a direction perpendicular to the direction in which the rail portion 1710 extends, and connects to the upper and lower ends of the sliding rail 1700. Referring to FIG. 2B, it can be seen that the deformation preventing portion 1713 extends across the backside 1710' (1711' denotes the backside of a horizontal rail portion and 1712' denotes the backside of a sloping rail portion). The upper end of the sliding rail 1700 refers to the top of the sliding rail 1700 based on FIG. 2B, and the lower end refers to the bottom of the sliding rail 1700 based on FIG. 2B. A plurality of deformation preventing portions 1713 may be provided and spaced at intervals.

The sliding rail 1700 is manufactured by injection molding, and injection-molded sliding rails 1700 might shrink or deform. Deformation may occur between the upper and lower ends of the sliding rail 1700, especially because they are spaced apart from each other. As the deformation prevention portion 1713 connects to the upper and lower ends of the sliding rail 1700, the upper and lower ends are supported by the deformation prevention portion 1713, thereby suppressing deformation.

The sliding rail 1700 has a hook insertion portion 1720. The hook insertion portion 1720 is for temporarily and permanently fixing the sliding rail 1700. The inner casing 1120*a* and 1120*b* (see FIG. 1B) has a hook portion protruding towards the hook insertion portion 1720 of the sliding rail 1700, and the hook insertion portion 1720 is formed to receive the hook portion. The hook insertion portion 1720 is in the form of a hole that opens to both the food storage compartment 1200 (see FIG. 1) and the inner casing 1120*a* and 1120*b* (see FIG. 1). The hook portion is hooked to the sliding rail 1700 through the hook insertion portion 1720, and a ridge, etc. for holding the hook portion in place may be formed around the hook insertion portion 1720.

The sliding rail 1700 includes fastening part insertion portions 1731*a* and 1732*a*. A plurality of fastening part insertion portions 1731*a* and 1732*a* may be provided. The fastening part insertion portions 1731*a* and 1732*a* are for permanently fixing the sliding rail 1700. Fastening parts 1731' and 1732' are for fastening the sliding rail 1700 and the inner casing 1120*a* and 1120*b* (see FIG. 1). For example, bolts correspond to the fastening parts 1731' and 1732'.

The fastening part insertion portions 1731*a* and 1732*a* are in the form of holes that open to one side and the other side of the sliding rail 1700. One side of the sliding rail 1700 refers to the side facing the food storage compartment 1200 (see FIG. 1), and the other side refers to the side facing the inner casing 1120*a* and 1120*b* (see FIG. 1). The perimeters of the fastening part insertion portions 1731*a* and 1732*a* are formed to receive the fastening parts 1731' and 1732'. The fastening parts 1731' and 1732' are fastened to the inner casing 1120*a* and 1120*b* (see FIG. 1) through the fastening part insertion portions 1731*a* and 1732*a*. The sliding rail 1700 is permanently fixed to the inner casing 1120*a* and 1120*b* (see FIG. 1) by the fastening parts 1731' and 1732' that are inserted into the fastening part insertion portions 1731*a* and 1732*a*.

The sliding rail 1700 has boss portions 1731*b* and 1732*b*. A plurality of boss portions 1731*b* and 1732*b* may be provided. The boss portions 1731*b* and 1732*b* are for permanently fixing the sliding rail 1700. The boss portions 1731*b* and 1732*b* are formed on the other side of the sliding rail 1700, and positioned to correspond to the fastening part insertion portions 1731*a* and 1732*a*.

The boss portions 1731*b* and 1732*b* are shaped in such a way as to surround the fastening part insertion portions 1731*a* and 1732*a* opening to the other side of the sliding rail 1700. Also, the boss portions 1731*b* and 1732*b* are formed in such a way as to surround the fastening parts 1731' and 1732' inserted into the fastening part insertion portions 1731*a* and 1732*a*. The fastening parts 1731' and 1732' are fastened to the inner casing 1120*a* and 1120*b* (see FIG. 1) through the fastening part insertion portions 1731*a* and 1732*a*, and the boss portions 1731*b* and 1732*b* have a predetermined thickness to support the fastening parts 1731' and 1732'.

Figure 4A:
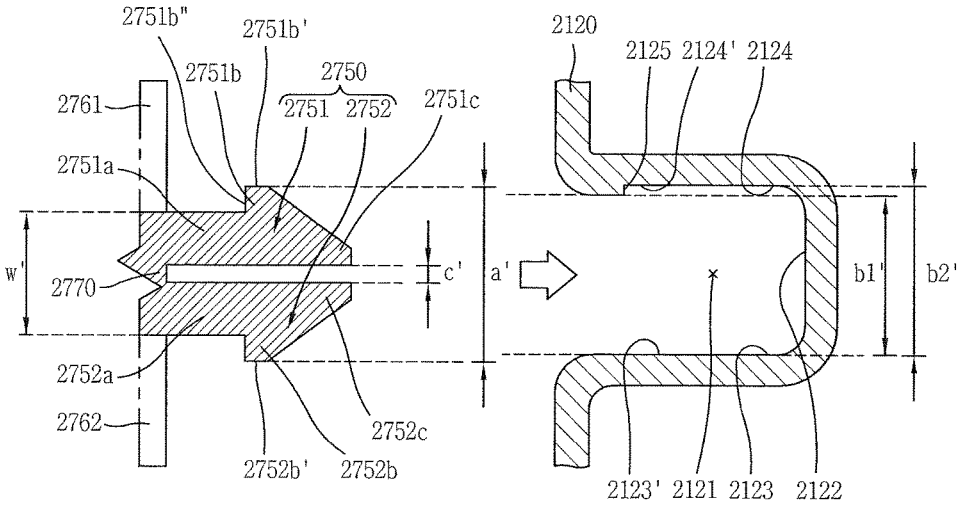
FIG. 4A is a diagram illustrating another example temporary fixing protrusion before being inserted into an example mounting recess.
Figure 4B:
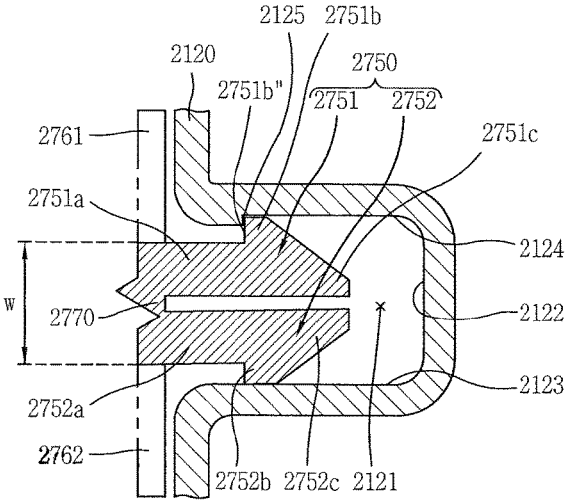
FIG. 4B is a diagram illustrating another example temporary fixing protrusion after being inserted into an example mounting recess.
Figure 5A:
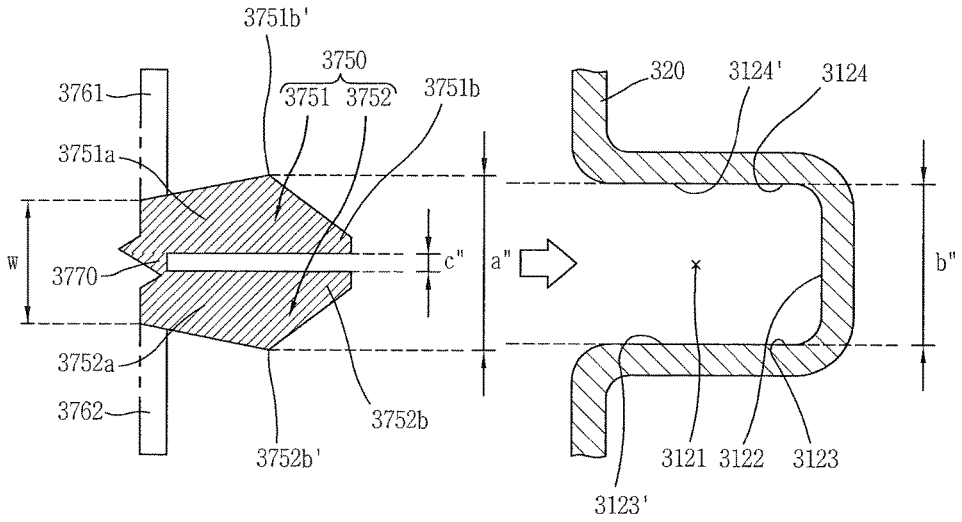
FIG. 5A is a diagram illustrating another example temporary fixing protrusion before being inserted into an example mounting recess.
Figure 5B:
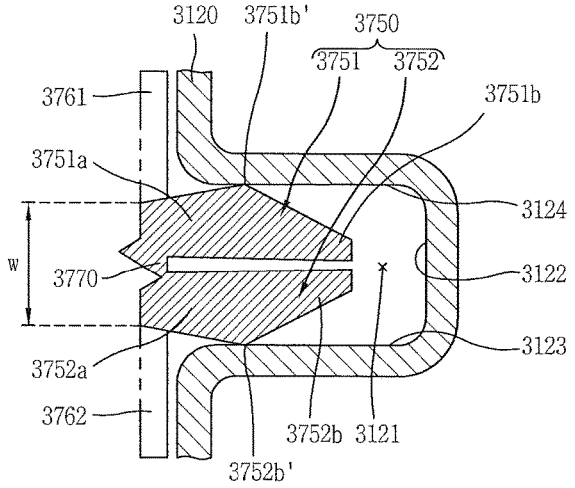
FIG. 5B is a diagram illustrating another example temporary fixing protrusion after being inserted into an example mounting recess.

The sliding rail 1700 has a temporary fixing structure for temporarily fixing to the inner casing 1120*a* and 1120*b* (see FIG. 1), 1120 (see FIGS. 3A and 3B), 2120 (see FIGS. 4A and 4B), and 3120 (see FIGS. 5A and 5B). The temporary fixing structure refers to a component including a temporary fixing protrusion 1750. Referring to FIG. 2B, the temporary fixing structure of the sliding rail 1700 is formed on the other side of the sliding rail 1700. A mounting recess 1121 (see FIGS. 3A and 3B, 2121 (see FIGS. 4A and 4B), and 3121 (see FIGS. 5A and 5B) is formed on the inner casing 1120*a* and 1120*b*, 1120, 2120, and 3120, corresponding to the temporary fixing structure of the sliding rail 1700. The sliding rail 1700 has a temporary fixing protrusion 1750 for temporarily fixing to the inner casing 1120*a* and 1120*b*, 1120, 2120, and 3120.

The temporary fixing protrusion 1750 protrudes from the sliding rail 1700 so as to be inserted into the mounting recess 1121, 2121, and 3121. The temporary fixing protrusion 1750 protrudes from the other side of the sliding rail 1700 towards the inner casing 1120*a* and 1120*b*, 1120, 2120, and 3120.

The temporary fixing protrusion 1750 consists of at least two segments that are drawn together by the inner periphery of the mounting recess 1121, 2121, and 3121. The at least two segments are a concept that include two or more segments. The two segments of the temporary fixing protrusion 1750 are configured to become closer by the inner periphery of the mounting recess 1121, 2121, and 3121.

The two segments of the temporary fixing protrusion 1750 may include a first projection 1751 and a second projection 1752 which are positioned to face each other. The first projection 1751 and the second projection 1752 may be spaced apart from each other. In some implementations, two projections 1751, 1752 can be symmetrical. In some implementations, the temporary fixing protrusion 1750 may include multiple projections including a first projection 1751, a second projection 1752, a third projection, . . . , and an nth projection (n is a natural number).

The temporary fixing protrusion 1750 of the sliding rail 1700 is for both temporary fixing and permanent fixing, since it remains inserted in the mounting recess 1121, 2121, and 3121 of the inner casing 1120*a* and 1120*b*, 1120, 2120, and 3120 even while the sliding rail 1700 is permanently fixed.

A base portion 1770 is formed to support the temporary fixing protrusion 1750. The base portion 1770 is formed to connect the rest of the sliding rail 1700, except the temporary fixing protrusion 1750, and the temporary fixing protrusion 1750. If the end of the temporary fixing protrusion 1750 farthest from the sliding rail 1700 is the upper end of the temporary fixing protrusion 1750, the base portion 1770 is formed on the lower end of the temporary fixing protrusion 1750.

Through holes 1761 and 1762 are formed on two opposite sides of the base portion 1770, respectively. The sliding rail 1700 is formed by injection molding. Molds for injection-molding the sliding rail 1700 consist of an upper mold and a lower mold. The through holes 1761 and 1762 are for making the upper mold or lower mold to escape after injection molding against the opposite mold (the opposite mold of the upper mold is the lower mold, and the opposite mold of the lower mold is the upper mold). The lower end of the temporary fixing protrusion 1750 may have the same width was the base portion 1770 so that the upper mold or lower mold can escape.

An edge portion 1780 is formed to surround the base portion 1770 and the through holes 1761 and 1762. The edge portion 1780 may be partially spaced apart from the base portion 1770 by the through holes 1761 and 1762. The edge portion 1780 may be made thicker than the rest of the sliding rail 1700. Since the temporary fixing protrusion 1750 protrudes from the base portion 1770, the connection rigidity between the temporary fixing protrusion 1750 and the base portion 1770 needs to be reinforced. Since the base portion 1770 and the edge portion 1780 are thicker than the rest of the sliding rail 1700, the connection rigidity may be naturally reinforced.

A fixing hook 1790 is formed on the opposite side of the roller 1740 of the sliding rail 1700. The fixing hook 1790 protrudes from the sliding rail 1700. The fixing hook 1790 may be pointed at the tip.

The fixing hook 1790 is for temporary and permanently fixing the sliding rail 1700. A hole corresponding to the fixing hook 1790 is formed on the inner casing 1120*a* and 1120*b*, 1120, 2120, and 3120, and the fixing hook 1790 is inserted and stuck in the hole in the inner casing 1120*a* and 1120*b*, 1120, 2120, and 3120. The fixing hook 1790 is used for temporarily fixing the sliding rail 1700, and remains inserted and stuck in the hole even after the permanent fixing.

The temporary and permanent fixing of the sliding rail 1700 are done in the following sequence.

By inserting the temporary fixing protrusion 1750 into the mounting recess 1121, 2121, and 3121 of the inner casing 1120*a* and 1120*b*, 1120, 2120, and 3120 while the fixing hook 1790 is inserted in the hole in the inner casing 1120*a* and 1120*b*, 1120, 2120, and 3120, the fixing hook 1790 is naturally held in place. Also, the two segments of the temporary fixing protrusion 1750 are drawn together in such a way as to become closer by the mounting recess 1121, 2121, and 3121. If the sliding rail 1700 is fixed to the inner casing 1120*a* and 1120*b*, 1120, 2120, and 3120 by the fixing hook 1790 and the temporary fixing protrusion 1750, this means that the sliding rail 170 is temporarily fixed.

After the sliding rail 1700 is temporarily fixed, the hole for inserting and holding the fixing hook 1790 in place is blocked by a subsidiary material such as tape, and an insulation foaming process is performed.

Upon completion of the insulation foaming process, fastening parts are inserted into the fastening part insertion portions 1731*a* and 1732*a* to permanently fix the sliding rail 1700 to the inner casing 1120*a* and 1120*b*, 1120, 2120, and 3120. If the sliding rail 1700 is fixed to the inner casing 1120*a* and 1120*b*, 1120, 2120, and 3120 by the fastening parts 1731' and 1732', as well as by the fixing hook 1790 and the temporary fixing protrusion 1750, this means that the sliding rail 1700 is permanently fixed.

In a structure in which a temporary fixing hole (another type of hole, which is different from the hole for the insertion of the fixing hook 1790), instead of the mounting recess 1121, 2121, and 3121, is formed on the inner casing, and a temporary fixing protrusion of the sliding rail, consisting of one segment, is inserted into the temporary fixing hole, a subsidiary material for blocking the temporary fixing hole is required, and a subsidiary material bonding process is needed. On the other hand, the temporary fixing structure eliminates the necessity of the subsidiary material by forming the mounting recess 1121, 2121, and 3121, instead of the temporary fixing hole, and omits the subsidiary material bonding process.

Figure 3A:
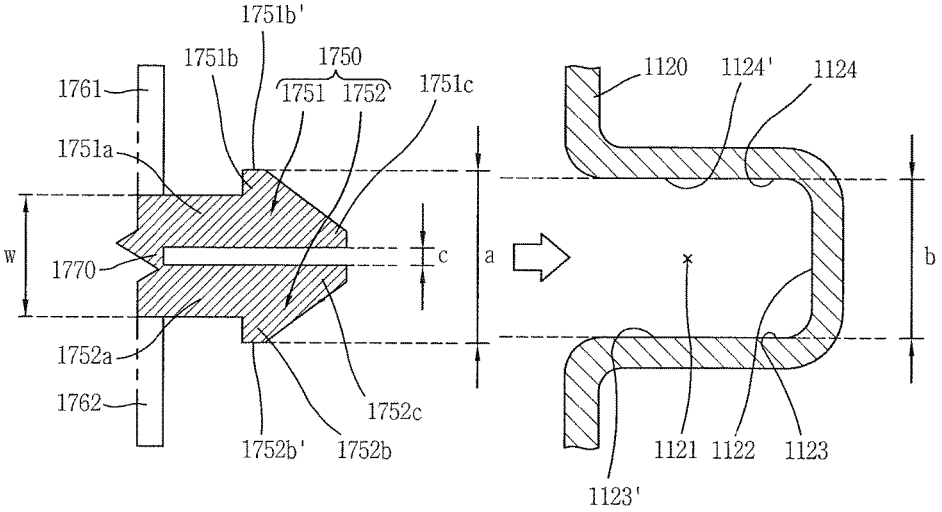
FIG. 3A is a diagram illustrating an example temporary fixing protrusion before being inserted into an example mounting recess.
Figure 3B:
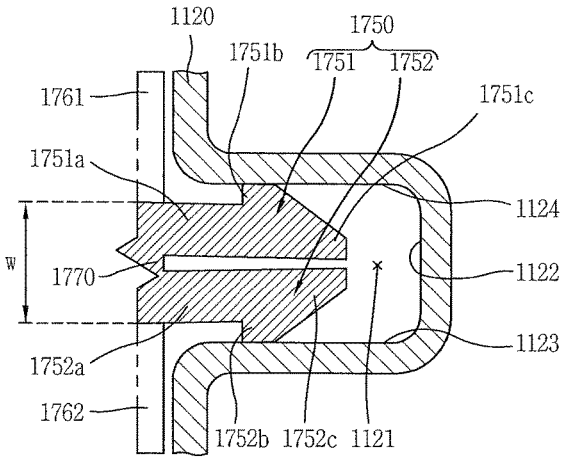
FIG. 3B is a diagram illustrating an example temporary fixing protrusion after being inserted into an example mounting recess.

FIGS. 3A and 3B illustrate an example temporary fixing protrusion before and after being inserted into an example mounting recess. For example, the example temporary fixing protrusion can be a temporary fixing protrusion 1750 and the example mounting recess can be a mounting recess 1121.

The mounting recess 1121 is formed by recessing at least part of the inner casing 1120 towards the outside of the food storage compartment 1200 (see FIG. 1). In FIGS. 3A and 3B, the left side of the inner casing 1120 corresponds to the inside of the food storage compartment 1200 (see FIG. 1), and the right side of the inner casing 1120 corresponds to the outside of the food storage compartment 1200 (see FIG. 1). Therefore, the mounting recess 1121 is recessed towards the outside of the food storage compartment 1200 (see FIG. 1), and exposed to the inside of the food storage compartment 1200 (see FIG. 1). Insulation is formed on the outside of the food storage compartment 1200 (see FIG. 1).

The perimeter 1122, 1123, and 1124 of the mounting recess 1121 forms a boundary between the food storage compartment 1200 (see FIG. 1) and the insulation. The perimeter 1122, 1123, and 1124 of the mounting recess 1121 refers to a portion that forms the mounting recess 1121 of the inner casing 1120, e.g., the area surrounding the temporary fixing protrusion 1750. Since the perimeter 1122, 1123, and 1124 of the mounting recess 1121 forms a boundary between the food storage compartment 1200 (see FIG. 1) and the insulation, the insulation is not exposed to the food storage compartment 1200 (see FIG. 1) through the mounting recess 1121.

The insulation is not exposed to the food storage compartment 1200 (see FIG. 1) in the refrigerator assembling process as well. Therefore, a liquid concentrate of insulation does not flow into the food storage compartment 1200 (see FIG. 1) through the mounting recess 1121 in the insulation foaming process as well, before the permanent fixing of the in-refrigerator parts after the temporary fixing. This is because the perimeter 1122, 1123, and 124 of the mounting recess 1121 forms the boundary between the food storage compartment 1200 (see FIG. 1) and the insulation.

Accordingly, there is no need to block the mounting recess 1121 using a subsidiary material such as tape when temporarily fixing the in-refrigerator parts to the inner casing 1120. The present disclosure can achieve a saving on subsidiary material such as tape for blocking the mounting recess, and also can omit the process of blocking the mounting recess 1121 by a subsidiary material during the refrigerator assembling process.

The first projection 1751 and the second projection 1752 include first portions 1751*a* and 1752*a*, second portions 1751*b* and 1752*b*, and third portions 1751*c* and 1752*c*. The respective portions of the first and second projections 1751 and 1752 are named the first portions 1751*a* and 1752*a*, the second portions 1751*b* and 1752*b*, and the third portions 1751*c* and 1752*c*, depending on their distance from the base portion 1770.

The first portions 1751*a* and 1752*a* protrude from the base portion 1770. The first portions 1751*a* and 1752*a* are spaced apart from the inner periphery of the mounting recess 1121. Referring to FIGS. 3A and 3B, it can be seen that the first portions 1751*a* and 1752*a* are smaller in size than the mounting recess 1121. Therefore, the first portions 1751*a* and 1752*a* are spaced apart from the inner periphery of the mounting recess 1121 even if they are inserted into the mounting recess 1121.

There is a stepped portion between the second portions 1751*b* and 1752*b* and the first portions 1751*a* and 1752*a* so that the second portions 1751*b* and 1752*b* have a larger circumference than the first portions 1751*a* and 1752*a*. Referring to FIGS. 3A and 3B, it can be seen that the second portions 1751*b* and 1752*b* have a larger circumference than the first portions 1751*a* and 1752*a*. When the second portions 1751*b* and 1752*b* are inserted into the mounting recess 1121, the second portions 1751*b* and 1752*b* come into contact with the inner periphery of the mounting recess 1121 and are pressed against the inner periphery of the mounting recess 1121. Thus, the first projection 1751 and the second projection 1752 are drawn together in such a way as to become closer.

The third portions 1751*c* and 1752*c* slope so that their cross-sectional area decreases as they get farther from the second portions 1751*b* and 1752*b*. The third portions 1751*c* and 1752*c* slope so that the temporary fixing protrusion 1750 is easily inserted into the mounting recess 1121. In a case where there is a stepped portion between the third portions 1751*c* and 1752*c* and the second portions 1751*b* and 1752*b* and the third portions 1751*c* and 1752*c* have the same circumference as the second portions 1751*b* and 1752*b*, the temporary fixing protrusion 1750 may be blocked by the entrance of the mounting recess 1121, making its insertion difficult. On the contrary, if the third portions 1751*c* and 1752*c* are configured to slope, the temporary fixing protrusion 1750 slides at the entrance of the mounting recess 1121, thus making it easy to insert the temporary fixing protrusion 1750 into the mounting recess 1121.

In order to temporarily fix the temporary fixing protrusion 1750 to the mounting recess 1121, the temporary fixing protrusion 1750 requires a structure that keeps it from easily deviating from the mounting recess 1121. Now, the structure that keeps the temporary fixing protrusion 1750 from easily deviating from the mounting recess 1121 will be described.

The two segments of the temporary fixing protrusion 1750 have contact points 1751*b*' and 1752*b*' that make contact with the inner periphery of the mounting recess 1121. The contact points 1751*b*' and 1752*b*' may be formed on the outer peripheries of the second portions 1751*b* and 1752*b* since the second portions 1751*b* and 1752*b* are pressed against the inner periphery of the mounting recess 1121. The outer peripheries of the second portions 1751*b* and 1752*b* are on opposite sides, as shown in FIGS. 3A and 3B, since the first projection 1751 and the second projection 1752 have the second portions 1751*b* and 1752*b*, respectively. If the structure of the temporary fixing protrusion 1750 changes, the positions of the contact points 1751*b*' and 1752*b*' may change as well. The two contact points 1751*b*' and 1752*b*' of the temporary fixing protrusion 1750 make contact with the inner periphery of the mounting recess 1121. Since the contact point 1751*b*' of the first projection 1751 and the contact point 1752*b*' of the second projection 1752 are on opposite sides, the distance between the two contact points 1751*b*' and 1752*b*' may be indicated by a, as shown in FIG. 3A.

The inner periphery of the mounting recess 1121 has two pressure points 1123' and 1124' so that the two contact points 1751*b*' and 1752*b*' on opposite sides are pressed in a direction that brings them closer to each other. The pressure points 1123' and 1124' are points on the perimeter 1122, 1123, and 1124 of the mounting recess 1121 that make contact with the second portions 1751*b* and 1752*b* of the temporary fixing protrusion 1750. The distance between the two pressure points 1123' and 1124' on opposite sides may be indicated by b, as shown in FIG. 3A.

The distance between the two segments of the temporary fixing protrusion 1750 may be indicated by c, as shown in FIG. 3A. The distance between the two segments of the temporary fixing protrusion 1750 refers to the distance between the first projection 1751 and the second projection 1752.

As shown in FIG. 3A, when the temporary fixing protrusion 1750 is not yet inserted into the mounting recess 1121, the distance a between the two contact points 1751*b*' and 1752*b*' is longer than the distance b between the two pressure points 1123' and 1124' (a>b). Thus, as shown in FIG. 3B, when the temporary fixing protrusion 1750 is inserted into the mounting recess 1121, the two pressure points 1123' and 1124' exert external force on the two contact points 1751*b*' and 1752*b*' in a direction that brings them closer to each other, and the first projection 1751 and the second projection 1752 tilt in a direction that brings them closer to each other.

Moreover, as shown in FIG. 3A, when the temporary fixing protrusion 1750 is not yet inserted into the mounting recess 1121, the difference a-b between the distance a between the two contact points 1751*b*' and 1752*b*' and the distance b between the two pressure points 1123' and 1124' is smaller than the distance c between the two segments (a−b<c). Thus, as shown in FIG. 3B, external force continues to be applied to the first projection 1751 and the second projection 1752 in a direction that bring them closer to each other, and the in-refrigerator part may be temporarily fixed to the inner casing 1120.

If the first portions 1751*a* and 1752*a* of the first projection 1751 and second projection 1752 have the same circumference as the second portions 1751*b* and 1752*b*, this makes it difficult for the first projection 1751 and the second projection 1752 to tilt in a direction that brings them closer to each other. Rather, an excessive external force may act on the boundary between the base portion 1770 and the first portions 1751*a* and 1752*a*, and therefore the boundary between the base portion 1770 and the first portions 1751*a* and 1752*a* may be broken. The first portions 1751*a* and 1752*a* have a smaller circumference than the second portions 1751*b* and 1752*b*, so the first projection 1751 and the second projection 1752 may tilt in a direction that brings them closer to each other and be kept from being subjected to excessive external force.

The temporary fixing achieved by the temporary fixing protrusion 1750 and the mounting recess 1121, may be done as the inner periphery of the mounting recess 1121 exerts pressure (action) on the temporary fixing protrusion 1750 and a force (reaction), caused by the at least two segments of the temporary fixing protrusion 1750 tending to go back to the state before they are drawn together, is continuously applied to the inner periphery of the mounting recess 1121.

The through holes 1761 and 1762 are formed on two opposite sides of the temporary fixing protrusion 1750, respectively. The temporary fixing protrusion 1750 protrude from the base portion 1770, and there is a stepped portion between the first portions 1751*a* and 1752*a* and second portions 1751*b* and 1752*b* of the temporary fixing protrusion 1750. If any one of the upper and lower molds has a stepped structure, the molds cannot be removed from an injection-molded part due to the stepped structure. Therefore, when injection-molding the sliding rail 1700 (see FIGS. 1 to 2B) using the upper and lower molds, the boundary between the upper and lower molds should be on the boundary between the first portions 1751*a* and 1752*a* and the second portions 1751*b* and 1752*b*. For example, the upper mold is placed to shape the first portions 1751*a* and 1752*a*, and the lower mold is placed to shape the second portions 1751*b* and 1752*b* and the third portions 1751*c* and 1752*c*. The upper mold is pressed tightly against the lower mold to injection-mold the sliding rail 1700 (see FIGS. 1 to 2B), and then released through the through holes 1761 and 1762.

Similarly, the base portion 1770 may have the same width was the first portions 1751*a* and 1752*a* or have a narrower width than the first portions 1751*a* and 1752*a*. If the base portion 1770 has a wider width the first portions 1751*a* and 1752*a*, the upper mold (or lower mold) cannot be released through the through holes 1761 and 1762. With the base portion 1770 having a narrower width than the first portions 1751*a* and 1752*a*, the rigidity may decrease. Thus, it is desirable that the base portion 1770 has the same width was the first portions 1751*a* and 1752*a*.

FIGS. 4A and 4B illustrate another example temporary fixing protrusion before and after being inserted into an example mounting recess. For example, the example temporary fixing protrusion can be a temporary fixing protrusion 2750 and the example mounting recess can be a mounting recess 2121.

A refrigerator 2000 (see FIG. 1) has a stepped portion 2125 on the perimeter of a mounting recess. The stepped portion 2125 may protrude from the inner periphery of the mounting recess 2121. The stepped portion 2125 also may be understood as being formed by recessing the inner periphery of the mounting recess 2121 (see FIG. 1).

The temporary fixing protrusion 2750 may have a bump 2751*b*" that gets stuck on the stepped portion 2125 when inserted into the mounting recess 2121. The bump 2751*b*" may partially protrude from the outer periphery of the temporary fixing protrusion 2750. Since there is a stepped portion at the boundary between the first portions 2751*a* and 2752*a* and second portions 2751*b* and 2752*b* of the temporary fixing protrusion 2750, the second portions 2751*b* and 2752*b* may be understood as protruding from the first portions 2751*a* and 2752*a*. In this case, the stepped portion forming the boundary between the first portions 2751*a* and 2752*a* and the second portions 2751*b* and 2752*b* may correspond to the bump 2751*b*".

The size b1' of the entrance of the mounting recess 2121 is smaller than the distance a' between the two contact points on the temporary fixing protrusion 2750. Therefore, when the temporary fixing protrusion 2750 is inserted into the mounting recess 2121, the temporary fixing protrusion 2750 is drawn together at the entrance of the mounting recess 2121. When the temporary fixing protrusion 2750 is inserted further into the mounting recess 2121 past the entrance of the mounting recess 2121, the bump 2751*b*" gets stuck on the stepped portion 2125 formed on the inside of the mounting recess 2121. This ensures that the in-refrigerator part can be temporarily fixed to the inner casing 2120 more firmly.

It is desirable that the stepped portion 2125 is formed only on one side of the inner periphery of the mounting recess 2121 so that it gets stuck on one of the first and second projections 2751 and 2752. If two stepped portions 2125 are formed on opposite sides and get stuck on the first and second projections 2751 and 2752, respectively, it gets difficult to take the temporary fixing protrusion 1750 out of the mounting recess 2121. Therefore, even if an in-refrigerator part is temporary fixed, it cannot be easily removed from the inner casing 2120.

By contrast, if the stepped portion 2125 is formed only on one side of the inner periphery of the mounting recess, the stepped portion 2125 may get stuck on only one of the first and second projections 2751 and 2752. Thus, the worker may move the in-refrigerator part, first in a direction (downwards in FIG. 4B) that brings it farther from the stepped portion 2125, to release it and then move the in-refrigerator part, secondly in a direction (left in FIG. 4B) in which it is taken out of the mounting recess 2121. In this way, the temporarily fixed in-refrigerator part may be released by removing it from the inner casing 2120.

As shown in FIG. 4A, while the temporary fixing protrusion 2750 is not inserted in the mounting recess 2121, the distance a' between the two contact points 2751' and 2752' is longer than the distance b2' between the two pressure points 2123' and 2124' (a'>b2'). Thus, as shown in FIG. 4B, when the temporary fixing protrusion 2750 is inserted into the mounting recess 2121, the two pressure points 2123' and 2124' exert external force on the two contact points 2751*b*' and 2752' in a direction that brings them closer to each other, and the first protrusion 2751 and the second protrusion 2752 tilt in a direction that bring them closer to each other.

Also, as shown in FIG. 4A, while the temporary fixing protrusion 2750 is not inserted in the mounting recess 2121, the difference a'−b2' between the distance a' between the two contact points 2751' and 2752' and the distance b2' between the two pressure points 2123' and 2124' is smaller than the distance c' between the two segments (a'−b2'<c'). Thus, as shown in FIG. 4B, the first projection 2751 and the second projection 2752 continue to be subjected to external force in a direction that bring them closer to each other, and the sliding rail may be temporarily fixed to the inner casing 2120.

Redundant descriptions of the perimeter 2122, 2123, and 2124 of the mounting recess 2121, the third portions 2751*c* and 2752*c* of the temporary fixing protrusion 2750, the through holes 2761 and 2762, and the base portion 2770, which have not been explained with reference to FIGS. 4A and 4B, will be omitted because they were explained with reference to FIGS. 3A and 3B.

FIGS. 5A and 5B illustrate another example temporary fixing protrusion before and after being inserted into an example mounting recess. For example, the example temporary fixing protrusion can be a temporary fixing protrusion 3750 and the example mounting recess can be a mounting recess 3121.

As explained above, the temporary fixing implemented by the temporary fixing protrusion 3750 and the mounting recess 3121 may be done as the inner periphery of the mounting recess 3121 exerts pressure (action) on the temporary fixing protrusion 3750, and a force (reaction), caused by the at least two segments of the temporary fixing protrusion 3750 tending to go back to the state before they are drawn together, is continuously applied to the inner periphery of the mounting recess 3121.

Accordingly, as actions and reactions occur between the temporary fixing is protrusion 3750 and the mounting recess 3121, specific shapes of the temporary fixing protrusion 3750 and mounting recess 3121 may be changed. While FIGS. 4A and 4B give an explanation of a modification of the shape of the mounting recess 2121, FIGS. 5A and 5B give an explanation of a modification of the shape of the temporary fixing protrusion 3750.

The first projection 3751 and the second projection 3752 include first sloping portions 3751*a* and 3752*a* and second sloping portions 3751*b* and 3752*b*. The respective portions of the first and second projections 3751 and 3752 are named the first sloping portions 3751*a* and 3752*a* and the second sloping portions 3751*b* and 3752*b*, depending on their distance from the base portion 3770.

The first sloping portions 3751*a* and 3752*a* protrude from the base portion 3770. The first sloping portions 3751*a* and 3752*a* slope so that their cross-sectional area increases as they get farther from the base portion 3770. Referring to FIGS. 5A and 5B, it can be seen that the rest of the first sloping portions 3751*a* and 3752*a*, except the boundary with the second sloping portions 3751*b* and 3752*b*, is smaller in size than the mounting recess 3121. Therefore, even if the first sloping portions 3751*a* and 3752*a* are inserted into the mounting recess 3121, the rest of the first sloping portions

3751*a* and 3752*a*, except the boundary with the second sloping portions 3751*b* and 3752*b*, is spaced apart from the inner periphery of the mounting recess 3121.

The second sloping portions 3751*b* and 3752*b* slope so that their cross-sectional area decreases as they get farther from the first sloping portions 3751*a* and 3752*a*. The boundary between the first sloping portions 3751*a* and 3752*a* and the second sloping portions 3751*b* and 3752*b* may be pressed against the inner periphery of the mounting recess 3121.

The boundary between the first sloping portions 3751*a* and 3752*a* and the second sloping portions 3751*b* and 3752*b* corresponds to the above-explained contact points 3751*b*' and 3752*b*'. As shown in FIG. 5A, while the temporary fixing protrusion 3750 is not inserted into the mounting recess 3121, the distance a" between the two contact points 3751*b*' and 3752*b*' is longer than the distance b" between the two pressure points 3123' and 3124' (a">b"). Thus, as shown in FIG. 5B, when the temporary fixing protrusion 3750 is inserted into the mounting recess 3121, the two pressure points 3123' and 3124' exert external force on the two contact points 3751*b*' and 3752' in a direction that brings them closer to each other, and the first protrusion 3751 and the second protrusion 3752 tilt in a direction that bring them closer to each other.

Also, as shown in FIG. 5A, while the temporary fixing protrusion 3750 is not inserted in the mounting recess 3121, the difference a"−b" between the distance a" between the two contact points 3751' and 3752' and the distance b" between the two pressure points 3123' and 3124' is smaller than the distance c" between the two segments (a"−b"<c"). Thus, as shown in FIG. 5B, the first projection 3751 and the second projection 3752 continue to be subjected to external force in a direction that bring them closer to each other, and the sliding rail may be temporarily fixed to the inner casing 3120.

Redundant descriptions of the perimeter 3122, 3123, and 3124 of the mounting recess 3121, the through holes 3761 and 3762, and the base portion 3770, which have not been explained with reference to FIGS. 3A and 5B, will be omitted because they were explained with reference to FIGS. 3A and 3B.

Figure 6:
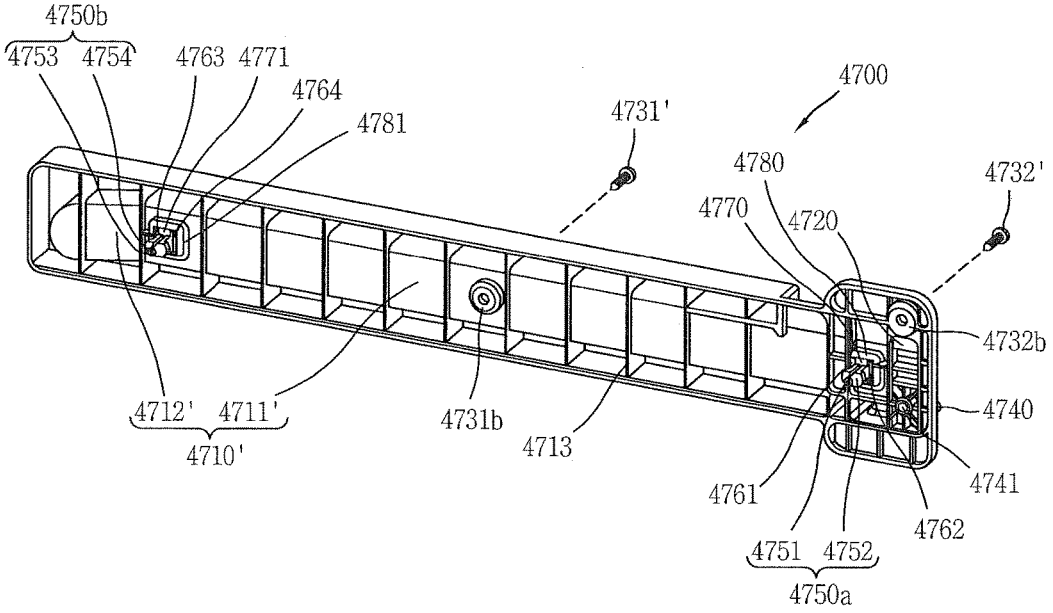
FIG. 6 is a diagram illustrating an example sliding rail and example temporary fixing protrusions.

FIG. 6 illustrates an example sliding rail and example temporary fixing protrusions. For example, the example sliding rail can be a sliding rail 4700 and the example temporary fixing protrusions can be multiple temporary fixing protrusions 4750*a*, 4750*b*.

The sliding rail 4700 may have a plurality of temporary fixing protrusions 4750*a* and 4750*b*, instead of the fixing hook 1790 (see FIG. 2B) explained with reference to FIG. 2B. The temporary fixing protrusions 4750*a* and 4750*b* may be spaced apart from each other. A structure of the temporary fixing protrusions 4750*a* and 4750*b* shown in FIG. 6 is identical to the structure of the temporary fixing protrusion 1750 explained with reference to FIGS. 2B to 3B.

If a plurality of temporary fixing protrusions 4750*a* and 4750*b*, instead of the fixing hook 1790, are formed on the sliding rail 4700, the inner casing 1120*a* and 1120*b* (see FIG. 1B), 1120 (see FIGS. 3A and 3B), 2120 (see FIGS. 4A and 4B), and 3120 (see FIGS. 5A and 5B) has no hole for inserting the fixing hook 1790.

Accordingly, the present disclosure can achieve further savings on subsidiary materials, such as tape, for blocking the hole corresponding to the fixing hook 1790 in the insulation foaming process, and also can omit an additional process, as subsidiary material bonding, for blocking the hole.

The sliding rail 4700 too has a roller 4740. The roller 1740 of the sliding rail 4700 is installed on one side of the sliding rail 4700, and located at the entrance of the rail portion. The slider has a sliding surface corresponding to the roller 4740 of the sliding rail 4700. When the roller of the slider rotates within the rail portion, the sliding surface slides while placed on the sliding rail 4700.

The sliding rail 4700 has a rotation axis support 4741. The rotation axis support 4741 is positioned radially with respect to the rotation axis of the roller 4740. The rotation axis of the roller 4740 extends towards the roller 4740 from the center of the rotation axis support 4741. The roller 4740 is attached in such a way as to be rotatable on the rotation axis, and rotates on the rotation axis.

A deformation preventing portion 4713 is formed on the other side of the sliding rail 4700. The deformation preventing portion 4713 is formed in a direction perpendicular to the direction in which the rail portion 4710 extends, and connects to the upper and lower ends of the sliding rail 4700. Referring to FIG. 6, it can be seen that the deformation preventing portion 4713 extends across the backside 4710' (4711' denotes the backside of a horizontal rail portion and 4712' denotes the backside of a sloping rail portion). The upper end of the sliding rail 4700 refers to the top of the sliding rail 4700 based on FIG. 6, and the lower end refers to the bottom of the sliding rail 4700 based on FIG. 6. A plurality of deformation preventing portions 4713 may be provided and spaced at intervals.

The sliding rail 4700 is manufactured by injection molding, and injection-molded sliding rails 4700 might shrink or deform. Deformation may occur between the upper and lower ends of the sliding rail 4700, especially because they are spaced apart from each other. As the deformation prevention portion 4713 connects to the upper and lower ends of the sliding rail 4700, the upper and lower ends are supported by the deformation prevention portion 4713, thereby suppressing deformation.

The sliding rail 4700 has a hook insertion portion 4720. The hook insertion portion 4720 is for temporarily and permanently fixing the sliding rail 1700. The inner casing 1120*a* and 1120*b* (see FIG. 1B), 1120 (see FIGS. 3A and 3B), 2120 (see FIGS. 4A and 4B), and 3120 (see FIGS. 5A and 5B) has a hook portion protruding towards the hook insertion portion 1720 of the sliding rail 1700, and the hook insertion portion 1720 is formed to receive the hook portion. The hook insertion portion 1720 is in the form of a hole that opens to both the food storage compartment 1200 (see FIG. 1) and the inner casing 1120*a* and 1120*b*, 1120, 2120, and 3120. The hook portion is hooked to the sliding rail 4700 through the hook insertion portion 4720, and a ridge, etc. for holding the hook portion in place may be formed around the hook insertion portion 4720.

The sliding rail 4700 has boss portions 4731*b* and 4732*b*. A plurality of boss portions 4731*b* and 4732*b* may be provided. The boss portions 4731*b* and 4732*b* are formed on the other side of the sliding rail 4700, and positioned to correspond to the fastening part insertion portions.

The boss portions 4731*b* and 4732*b* are shaped in such a way as to surround the fastening part insertion portions opening to the other side of the sliding rail 4700. Also, the boss portions 4731*b* and 4732*b* are formed in such a way as to surround the fastening parts 4731' and 4732' inserted into the fastening part insertion portions 4731*a* and 4732*a*. The fastening parts 4731' and 4732' are fastened to the inner casing 1120*a* and 1120*b*, 1120, 2120, and 3120 through the fastening part insertion portions, and the boss portions

4731*b* and 4732*b* have a predetermined length to support the fastening parts 4731' and 4732'.

The temporary fixing protrusions 4750*a* and 4750*b* protrude from the sliding rail 4700 so as to be inserted into the mounting recesses 1121 (see FIGS. 3A and 3B), 2121 (see FIGS. 4A and 4B), and 3121 (see FIGS. 5A and 5B). The temporary fixing protrusions 4750*a* and 4750*b* protrude from the other side of the sliding rail 4700 towards the inner casing 1120*a* and 1120*b*, 1120, 2120, and 3120.

The temporary fixing protrusion 4750*a* and 4750*b* each consist of at least two segments that are drawn together by the inner periphery of the mounting recess 1121, 2121, and 3121. The at least two segments are a concept that include two or more segments. The two segments of each of the temporary fixing protrusions 4750*a* and 4750*b* are configured to become closer by the inner periphery of the mounting recess 1121, 2121, and 3121.

The two segments of each of the temporary fixing protrusion 4750*a* and 4750*b* may include a first projection 4751 and 4753 and a second projection 4752 and 4754 which are positioned to face each other. The first projection 4751 and 4753 and the second projection 4752 and 4754 may be spaced apart from each other. In some implementations, the projections 4751-4754 can be symmetrical. In some implementations, each of the temporary fixing protrusions 4750*a* and 4750*b* may respectively include multiple projections including a first projection 4751 and 4753, a second projection 4752 and 4754, a third projection, . . . , and an nth projection (n is a natural number).

The temporary fixing protrusions 4750*a* and 4750*b* of the sliding rail 4700 are for both temporary fixing and permanent fixing, since they remain inserted in the mounting recesses 1121, 2121, and 3121 of the inner casing 1120*a* and 1120*b*, 1120, 2120, and 3120 even while the sliding rail 1700 is permanently fixed. Base portions 4770 and 4771 are formed to support the temporary fixing protrusions 4750*a* and 4750*b*. The base portions 4770 and 4771 are formed to connect the rest of the sliding rail 1700, except the temporary fixing protrusions 4750*a* and 4650*b*, and the temporary fixing protrusions 4750*a* and 4750*b*. If the end of the temporary fixing protrusions 4750*a* and 4750*b* farthest from the sliding rail 4700 is the upper end of the temporary fixing protrusions 4750*a* and 4750*b*, the base portions 4770 and 4771 are formed on the lower end of the temporary fixing protrusions 4750*a* and 4750*b*.

Through holes 4761, 4762, 4763, and 4764 are formed on two opposite sides of the base portions 4770 and 4771, respectively. The sliding rail 4700 is formed by injection molding. Molds for injection-molding the sliding rail 4700 consist of an upper mold and a lower mold. The through holes 4761, 4762, 4763, and 4764 are for releasing the upper mold or lower mold from the other mold after injection molding. The lower end of the temporary fixing protrusion 4750*a* and 4750*b* may have the same width as the base portions 4770 and 4771 to release the upper mold or lower mold.

Edge portions 4780 and 4781 are formed to surround the base portions 4770 and 4771 and the through holes 4761, 4762, 4763, and 4764. The base portions 4770 and 4771 and the edge portions 4780 and 4781 may be made thicker than the rest of the sliding rail 4700. Since the temporary fixing protrusions 4750*a* and 4750*b* protrude from the base portions 4770 and 4771, the connection rigidity between the temporary fixing protrusions 4750*a* and 4750*b* and the base portions 4770 and 4771 needs to be reinforced. Since the base portions 4770 and 4771 and the edge portions 4780 and 4781 are thicker than the rest of the sliding rail 4700, the connection rigidity may be naturally reinforced.

Figure 7A:
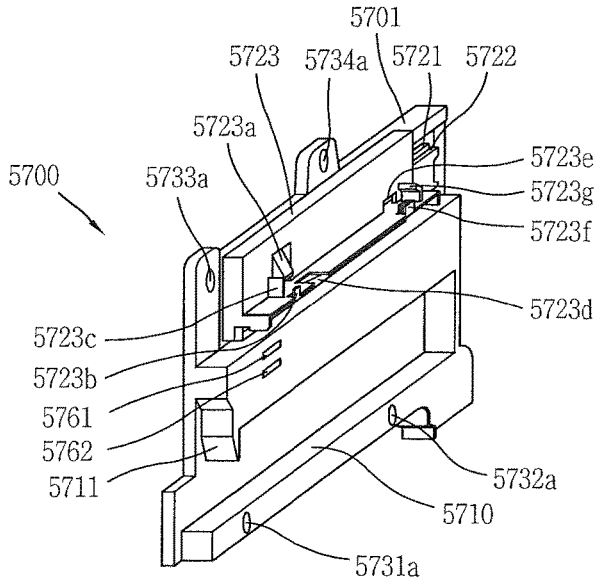
FIGS. 7A and 7B are diagrams illustrating an example sliding module and an example temporary fixing structure.
Figure 7B:
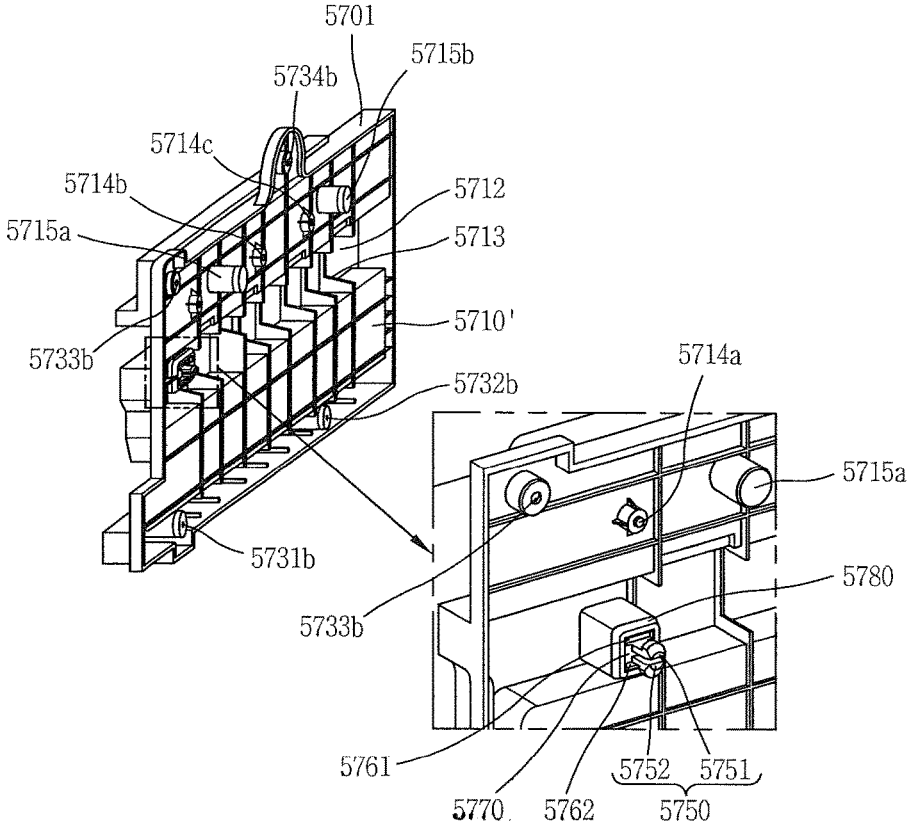

FIGS. 7A and 7B illustrate an example sliding module and an example temporary fixing protrusion. For example, the example sliding module can be a sliding module 5700 and the example temporary fixing protrusion can be a temporary fixing protrusion 5750. FIG. 7A illustrates one side of the sliding module 5700 facing the food storage compartment 1200 in FIG. 1. FIG. 7B illustrates another side of the sliding module 5700 positioned to face the inner casing 1120*a* and 1120*b* in FIG. 1), 1120 (see FIGS. 3A and 3B), 2120 (see FIGS. 4A and 4B), and 3120 (see FIGS. 5A and 5B).

The sliding module 5700 includes a rail portion 5710. The rail portion 5710 is formed on one side of the sliding module 5700. The rail portion 5710 extends from the front of the food storage compartment 1200 (see FIG. 1) to the rear (or extends from the rear to the front). A roller is installed on the side of a lower drawer, and the rail portion 5710 is configured to define a moving area for the roller.

The roller of the lower drawer is mounted on the rail portion 5710, and rotates with the rail portion 5710. When the roller of the lower drawer rotates, the lower drawer may slide into or out of the food storage compartment 1200 (see FIG. 1).

A ridge 5711 is formed at the entrance of the rail portion 5710. The ridge 5711 protrudes to partially block the entrance of the rail portion 5710. The ridge 5711 is configured to prevent the lower drawer from deviating. The roller of the lower drawer may get stuck on the ridge 5711, and the ridge 5711 may keep the lower drawer from arbitrarily deviating laterally from the refrigerator 1000 (see FIG. 1).

A first sliding portion 5721, a second sliding portion 5722, and an upper drawer attaching portion 5723 are formed in the upper part of the rail portion 5710.

The first sliding portion 5721 is fixed to an inner casing attaching portion 5701. The inner casing attaching portion 5701 refers to a part that is formed integrally with the rail portion 5701 and the ridge 5711 and temporarily and permanently fixed to the inner casing 1120*a* and 1120*b*, 1120, 2120, and 3120. The inner casing attaching portion 5701, the rail portion 5701, and the ridge 5711 may be formed integral with one another by injection molding.

The second sliding portion 5722 may slide in the direction of extension of the first sliding portion 5721. The first sliding portion 5721 and the second sliding portion 5722 extend substantially parallel to each other. The second sliding portion 5722 is fixed to the upper drawer attaching portion 5723.

The upper drawer attaching portion 5723 is an area where the upper drawer is mounted. The upper drawer attaching portion 5723 has a first attaching portion 5723*a*, 5723*b*, and 5723*c* at the front, a second attaching portion 5723*e*, 5723*f*, and 5723*g* at the rear, and a receiving portion 5723*d* between the first attaching portion 5723*a*, 5723*b*, and 5723*c* and the second attaching portion 5723*e*, 5723*f*, and 5723*g*.

The first attaching portion 5723*a*, 5723*b*, and 5723*c* consists of an attachment hook 5723*a* and a plurality of deviation preventing projections 5723*b* and 5723*c*. A certain part of the upper drawer is inserted into a space consisting of the attachment hook 5723*a* and the plurality of deviation preventing projections 5723*b*. The deviation preventing projections 5723*b* and 5723*c* serve to prevent the certain part of the upper drawer from deviating from the first attaching portion 5723*a*, 5723*b*, and 5723*c*.

The receiving portion 5723*d* receives another part of the upper drawer. As another part of the upper drawer is inserted into the receiving portion 5723*d*, the upper drawer attaching portion 5723 may be attached to the upper drawer in its normal position.

The second attaching portion 5723*e*, 5723*f*, and 5723*g* may consist of an attachment hole (or attachment recess) 5723*e* and a plurality of deviation preventing projections 5723*f* and 5723*g*. Yet another part of the upper drawer is inserted into the attachment hole 5723*e*. The plurality of deviation preventing projections 5723*f* and 5723*g* serve to prevent the yet another part of the upper drawer from deviating from the second attaching portion 5723*e*, 5723*f*, and 5723*g* by supporting the side and back of the yet another part of the upper drawer on the side and the back.

Since the first sliding portion 5721 and the second sliding portion 5722 can slide with respect to each other, the upper drawer attached to the upper drawer attaching portion 5723 can slide into or out of the food storage compartment 5200 (see FIG. 1). The upper drawer and the lower drawer may slide independently of each other.

The sliding module 5700 has fastening part insertion portions 5731*a*, 5732*a*, 5733*a*, and 5734*a*. A plurality of fastening part insertion portions 5731*a*, 5732*a*, 5733*a*, and 5734*a* may be provided. The fastening part insertion portions 5731*a*, 5732*a*, 5733*a*, and 5734*a* are for permanently fixing the sliding module 5700. Fastening parts are for fastening the sliding module 5700 and the inner casing 1120*a* and 1120*b* (see FIG. 1), 1120 (see FIGS. 3A and 3B), 2120 (see FIGS. 4A and 4B), and 3120 (see FIGS. 5A and 5B). For example, bolts correspond to the fastening parts.

The fastening part insertion portions 5731*a*, 5732*a*, 5733*a*, and 5734*a* are in the form of holes that open to one side and the other side of the sliding rail 1700. One side of the sliding module 500 refers to the side facing the food storage compartment 5200 (see FIG. 1), and the other side refers to the side facing the inner casing 1120*a* and 1120*b*, 1120, 2120 and 3120. The perimeters of the fastening part insertion portions 5731*a*, 5732*a*, 5733*a*, and 5734*a* are formed to receive the fastening parts. The fastening parts are fastened to the inner casing 1120*a* and 1120*b*, 1120, 2120 and 3120 through the fastening part insertion portions 5731*a*, 5732*a*, 5733*a*, and 5734*a*. The sliding module 5700 is permanently fixed to the inner casing 1120*a* and 1120*b*, 1120, 2120 and 3120 by the fastening parts that are inserted into the fastening part insertion portions 5731*a*, 5732*a*, 5733*a*, and 5734*a*.

The sliding module 5700 has boss portions 5714*a*, 5714*b*, 5714*c*, 5731*b*, 5732*b*, 5733*b*, and 5734*b*. A plurality of boss portions 5714*a*, 5714*b*, 5714*c*, 5731*b*, 5732*b*, 5733*b*, and 5734*b* may be provided. The boss portions 5714*a*, 5714*b*, 5714*c*, 5731*b*, 5732*b*, 5733*b*, and 5734*b* may be divided into first boss portions 5714*a*, 5714*b*, and 5714*c* and second boss portions 5732*b*, 5733*b*, and 5734*b*, depending on what they are coupled to.

The first boss portions 5714*a*, 5714*b*, and 5714*c* are for fixing the first sliding portion 5721 to the inner casing attaching portion 5701. The first boss portions 5714*a*, 5714*b*, and 5714*c* are formed on the other side of the sliding module 5700. The first boss portions 5714*a*, 5714*b*, and 5714*c* are formed in such a way as to surround the fastening parts inserted to fix the first sliding portion 5721. The fastening parts inserted to fix the first sliding portion 5721 is not illustrated in FIG. 7A because it is visually blocked by the upper drawer attaching portion 5723. The second boss portions 5732*b*, 5733*b*, and 5734*b* are for permanently fixing the sliding module 5700 to the inner casing 1120*a* and 1120*b*, 1120, 2120, and 3120. The second boss portions 5732*b*, 5733*b*, and 5734*b* are formed on the other side of the sliding module 5700, and positioned to correspond to the fastening part insertion portions 5731*a*, 5732*a*, 5733*a*, and 5734*a*.

The second boss portions 5732*b*, 5733*b*, and 5734*b* are shaped in such a way as to surround the fastening part insertion portions 5731*a*, 5732*a*, 5733*a*, and 5734*a* opening to the other side of the sliding module 5700. Also, the second boss portions 5732*b*, 5733*b*, and 5734*b* are formed in such a way as to surround the fastening parts inserted into the fastening part insertion portions 5731*a*, 5732*a*, 5733*a*, and 5734*a*. The fastening parts are fastened to the inner casing 1120*a* and 1120*b*, 1120, 2120, and 3120 through the fastening part insertion portions 5731*a*, 5732*a*, 5733*a*, and 5734*a*, and the second boss portions 5731*a*, 5732*a*, 5733*a*, and 5734*a* have a predetermined thickness to support the fastening parts.

The sliding module 5700 has positioning projections 5715*a* and 5715*b*. The positioning projections 5715*a* and 5715*b* protrude from the other side of the sliding module 5700. Positioning recesses corresponding to the positioning projections 5715*a* and 5715*b* are formed on the inner casing 1120*a* and 1120*b*, 1120, 2120, and 3120. The positioning projections 5715*a* and 5715*b* are inserted into the positioning recesses when temporarily fixing the sliding module 5700. Thus, the sliding module 5700 may be attached to the inner casing 1120*a* and 1120*b*, 1120, 2120, and 3120 in its normal position.

A deformation preventing portion 5713 is formed on the other side of the sliding module 5700. The deformation preventing portion 5713 protrudes in a direction at right angles to the direction in which the rail portion 5710 extends, and connects to the upper and lower ends of the sliding module 5700. The upper end is refers to the top of the sliding module 5700 based on FIG. 7B, and the lower end refers to the bottom of the sliding module 5700 based on FIG. 7B. A plurality of deformation preventing portions 5713 may be provided and spaced at intervals.

The sliding module 5700 is manufactured by injection molding, and injection-molded sliding rails 5700 might shrink or deform. Deformation may occur between the upper and lower ends of the sliding module 5700, especially because they are spaced apart from each other. As the deformation prevention portion 5713 connects to the upper and lower ends of the sliding module 5700, the upper and lower ends are supported by the deformation prevention portion 5713, thereby suppressing deformation.

The sliding module 5700 has the temporary fixing protrusion 5750 for temporarily fixing to the inner casing 1120*a* and 1120*b*, 1120, 2120, and 3120. Referring to FIG. 7B, the temporary fixing protrusion 5750 of the sliding module 5700 is formed on the other side of the sliding module 5700. The mounting recess 1121, 2121, and 3121 is formed on the inner casing 1120*a* and 1120*b*, 1120, 2120, and 3120, corresponding to the temporary fixing protrusion 5750 of the sliding module 5700.

The temporary fixing protrusion 5750 protrudes from the sliding module 5700 so as to be inserted into the mounting recess 1121, 2121, and 3121. The temporary fixing protrusion 5750 protrudes from the other side of the sliding module 5700 towards the inner casing 1120*a* and 1120*b*, 1120, 2120, and 3120.

The temporary fixing protrusion 5750 may include multiple segments that are drawn together by the inner periphery of the mounting recess 1121, 2121, and 3121. In some implementations, the temporary fixing protrusion 5750 may include two segments that are branched before being inserted into the mounting recess 1121, 2121, and 3121.

When the two segments of the temporary fixing protrusion 5750 are inserted into the mounting recess 1121, 2121, and 3121, the two segments are pressed by the inner periphery of the mounting recess 1121, 2121, and 3121 and the two segments become closer.

The two segments of the temporary fixing protrusion 5750 may include a first projection 5751 and a second projection 5752 which are positioned to face each other. The first projection 5751 and the second projection 5752 may be spaced apart from each other. In some implementations, two projections 5751, 5752 can be symmetrical. In some implementations, the temporary fixing protrusion 5750 may include multiple projections including a first projection 5751, a second projection 5752, a third projection, . . . , and an nth projection (n is a natural number).

The temporary fixing protrusion 5750 of the sliding module 5700 is for both temporary fixing and permanent fixing, since it remains inserted in the mounting recess 1121, 2121, and 3121 of the inner casing 1120*a* and 1120*b*, 1120, 2120, and 3120 even while the sliding module 5700 is permanently fixed.

A base portion 5770 is formed to support the temporary fixing protrusion 5750. The base portion 5770 is formed to connect the rest of the sliding module 5700, except the temporary fixing protrusion 5750, and the temporary fixing protrusion 5750. If the end of the temporary fixing protrusion 5750 farthest from the sliding module 5700 is the upper end of the temporary fixing protrusion 5750, the base portion 5770 is formed on the lower end of the temporary fixing protrusion 5750.

The base portion 5770 may protrude from the sliding module 5700. The sliding module 5700 is formed by injection molding, and a thick injection-molded part may deform after the injection molding. Thus, the injection-molded part cannot be made infinitely thick. Because the perimeter of the rail portion 5710 protrudes further than the rail portion 5710, the backside 5712 of the perimeter needs to be recessed from the backside 5710' of the rail portion 5710 to prevent deformation.

If the temporary fixing protrusion 5750 is located on the backside 5712 of the perimeter, as shown in FIG. 7B, the temporary fixing protrusion 5750 is positioned in an area that is more recessed than the backside 5710' of the rail portion 5710. Thus, if the temporary fixing protrusion 5750 is short in length, the temporary fixing protrusion 5750 may not be inserted into the inner casing 1120*a* and 1120*b*, 1120, 2120, and 3120. To solve this problem, the base portion 5770 and edge portion 5780 of the temporary fixing protrusion 5750 may protrude as much as the backside 5710' of the rail portion 5710 does, and the temporary fixing protrusion 5750 may be inserted into the inner casing 1120*a* and 1120*b*, 1120, 2120, and 3120.

Through holes 5761 and 5762 are formed on both sides of the base portion 5770. The sliding module 5700 is formed by injection molding. Molds for injection-molding the sliding module 5700 consist of an upper mold and a lower mold. The through holes 5761 and 5762 are for releasing the upper mold or lower mold from the other mold after injection molding against the opposite mold. The lower end of the temporary fixing protrusion 5750 may have the same width was the base portion 5770 to release the upper mold or lower mold.

The edge portion 5780 is formed to surround the base portion 5770 and the through holes 5761 and 5762. The base portion 5770 and the edge portion 5780 may be made thicker than the rest of the sliding module 5700. Since the temporary fixing protrusion 5750 protrudes from the base portion 5770, the connection rigidity between the temporary fixing protrusion 5750 and the base portion 5770 needs to be reinforced. Since the base portion 5770 and the edge portion 5780 are thicker than the rest of the sliding module 5700, the connection rigidity may be naturally reinforced.

Hereinafter, another component of a refrigerator that requires temporary fixing will be described.

Figure 8:
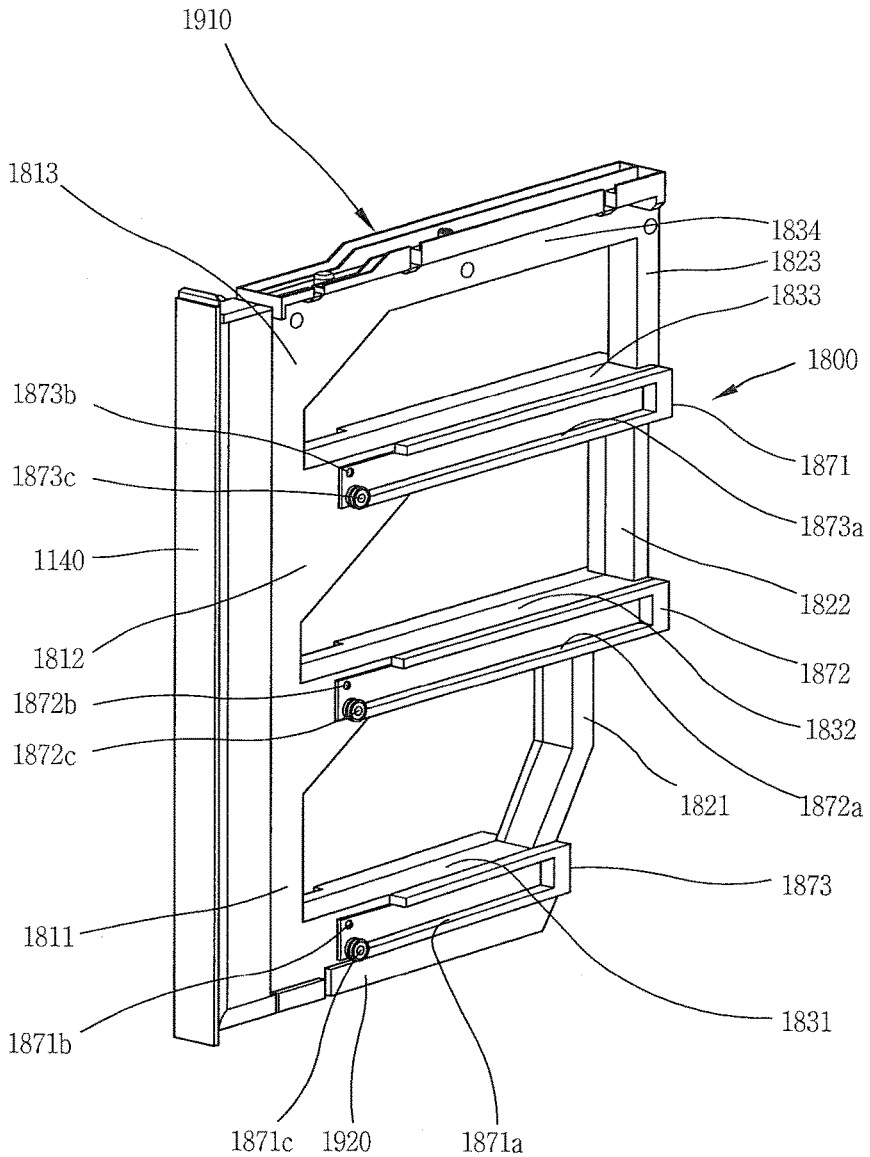
FIG. 8 is a diagram illustrating an example vertical bar, an example bracket, and example bracket holders.

FIG. 8 illustrates an example vertical bar, an example bracket, and example bracket holders. For example, the example vertical bar can be a vertical bar 1140, the example bracket can be a bracket 1800, and the example bracket holders can be bracket holders 1910 and 1920.

The vertical bar 1149 extends vertically. As explained above, the vertical bar 1140 is installed at the front openings 1100*a* and 1100*b* of at least one between the chiller compartment 1210 (see FIG. 1) and freezer compartment 1220 (see FIG. 1). In a case where the vertical bar 1140 is installed at the chiller compartment 1210 (see FIG. 1), one end of the vertical bar 1140 connects to the upper wall of the chiller compartment 1210 (see FIG. 1), and the other end of the vertical bar 1140 connects to the base of the chiller compartment 1210 (see FIG. 1). In a case where the vertical bar 1140 is installed at the freezer compartment 1220 (see FIG. 1), one end of the vertical bar 1140 connects to the upper wall of the freezer compartment 1220 (see FIG. 1), and the other end of the vertical bar 1140 connects to the base of the freezer compartment 1220 (see FIG. 1).

The bracket 1800 is installed on the back of the vertical bar 1140. As explained with reference to FIG. 1, the bracket 1800 may be installed on the back of the vertical bar 1140 and the back wall 1120*b* of the inner casing 1120*a* and 1120*b* (see FIG. 1), 1120 (see FIGS. 3A and 3B), 2120 (see FIGS. 4A and 4B), and 3120 (see FIGS. 5A and 5B). The front part of the bracket 1800 is positioned to face the back of the vertical bar 1140, and the rear part of the bracket 1800 is positioned to face the back wall 1120*b* (see FIG. 1) of the inner casing 1120*a* and 1120*b*, 1120, 2120, and 3120.

The bracket 1800 is configured to divide the freezer compartment 1220 (see FIG. 1) or the chiller compartment 1210 (see FIG. 1) into left and right sections. The freezer compartment 1220 (see FIG. 1) or the chiller compartment 1210 (see FIG. 1) is divided into left and right sections with respect to the bracket 1800. However, as shown in FIG. 8, the bracket 1800 does not completely block the left and right sections of the freezer compartment 1220 (see FIG. 1) or the chiller compartment 1210 (see FIG. 1) off from each other. Cool air may flow from the left side of the freezer compartment 1220 (see FIG. 1) or chiller compartment 1210 (see FIG. 1) to the right side or vice versa through a hole in the bracket 1800.

Sliding rails 1871, 1872, and 1873 are attached to either side of the bracket 1800. The sliding rails 1871, 1872, and 1873 attached to the bracket 1800 are paired with the sliding rails 1700 (see FIG. 1) and 4700 (see FIG. 6) that are attached to the inner casing 1120*a* and 1120*b*, 1120, 2120, and 3120, thereby allowing for the sliding movement of the sliders.

Unlike the sliding rail s1700 and 4700 attached to the inner casing 1120*a* and 1120*b*, 1120, 2120, and 312, the sliding rails 1871, 1872, and 1873 attached to the bracket 1800 have nothing to do with temporary fixing. Thus, the sliding rails 1871, 1872, and 1873 are only permanently fixed to the bracket 1800 by fastening parts such as bolts, and the sliding rails 1871, 1872, and 1873 have fastening part insertion portions 1871*b*, 1872*b*, respectively, for permanent fixing. The sliding rails 1871, 1872, and 1873 have rail portions 1871*a*, 1872*a*, and 1873*a* and rollers 1871*c*,

1872*c*, and 1873*c*, for the sliding movement of the sliders. The structures and functions of the rail portions 1871*a*, 1872*a*, and 1873*a* and rollers 1871*c*, 1872*c*, and 1873*c* are substantially identical to those of the sliding rails 1700 (see FIG. 2) explained above with reference to FIGS. 2A and 2B.

The bracket of FIG. 8 is in three-stages. The three sliding rails 1871, 1872, and 1873 differ in height, and are installed on the left and right of the bracket 1800. The sliding rails 1871, 1872, and 1873 installed on the bracket 1800 allow for the sliding movement of the trays 1520 (see FIG. 1) or drawers. It can be assumed that three trays 1520 or drawers are located on the left and right sides of the freezer compartment 1220 (see FIG. 1) or chiller compartment 1210 (see FIG. 1). It should be noted that the number of stages of the bracket 1800 may vary.

The bracket 1800 consists of front parts 1811, 1812, and 1813, rear parts 1821, 1822, and 1823, and front-rear extensions 1831, 1832, 1833, and 1834.

The front parts 1811, 1812, and 1813 on each stage are positioned to face the back of the vertical bar 1140. The front parts 1811, 1812, and 1813 on each stage may partially slope so as to support the front-rear extensions 1831, 1832, 1833, and 1834.

The rear parts 1821, 1822, and 1823 are positioned to face the back wall 1120*b* (see FIG. 1) of the inner casing 1120*a* and 1120*b*, 1120, 2120, and 3120. Unlike the other rear parts 1822 and 1823, the rear part 1821 on the lowermost stage is configured to make room for the machine room at the rear of the inner casing 1120*a* and 1120*b*, 1120, 2120, and 3120.

The front-rear extension 1831 is shorter in length than the other front-rear extensions 1832, 1833, and 1834, and the rear part 1821 on the lowermost stage is connected to midway along the length of the front-rear extension 1832 on the stage (second stage) immediately above it. Although not shown, the back wall 1120*b* of the inner casing 1120*a* and 1120*b*, 1120, 2120, and 3120 has a shape corresponding to the shape of the rear parts 1821, 1822, and 1823 of the bracket 1800. Thus, a part of the inner casing 1120*a* and 1120*b*, 1120, 2120, and 3120 facing the lowermost stage of the bracket 1800 protrudes into the food storage compartment 1200 (see FIG. 1), unlike the rest of the inner casing 1120*a* and 1120*b*, 1120, 2120, and 3120. Then, the machine room may be provided behind the protruding part.

The front-rear extensions 1831, 1832, 1833, and 1834 extends front and back to connect the front parts 1811, 1812, and 1813 and the rear parts 1821, 1822, and 1823. The above-explained sliding rails 1871, 1872, and 1873 may be attached to the side of the front-rear extensions 1831, 1832, and 1833 but not to the side of the front-rear extension 1834 on the uppermost stage.

The bracket holders 1910 and 1920 allow for supporting the bracket 1800. The bracket holders 1910 and 1920 are temporarily fixed to the inner casing 1120*a* and 1120*b*, 1120, 2120, and 3120 and then permanently fixed after insulation foaming. Therefore, the in-refrigerator part includes bracket holders 1910 and 1920 which are attached to the bracket 1800 to support the bracket 1800. The bracket holders 1910 and 1920 correspond to the in-refrigerator part in their narrower sense.

The bracket holders 1910 include an upper bracket holder 1910 and a lower bracket holder 1920. The upper bracket holder 1910 is installed between the top of the bracket 1800 and the upper wall of the inner casing 120*a* and 1120*b*, 1120, 2120, and 3120. As used herein, the top of the bracket 1800 refers to the front-rear extension 1834 on the uppermost stage. The lower bracket holder 1920 is installed between the bottom of the bracket 1800 and the base of the inner casing 120*a* and 1120*b*, 1120, 2120, and 3120. As used herein, the bottom of the bracket 1800 refers to the front-rear extension 1831 on the lowermost stage.

Figure 9A:
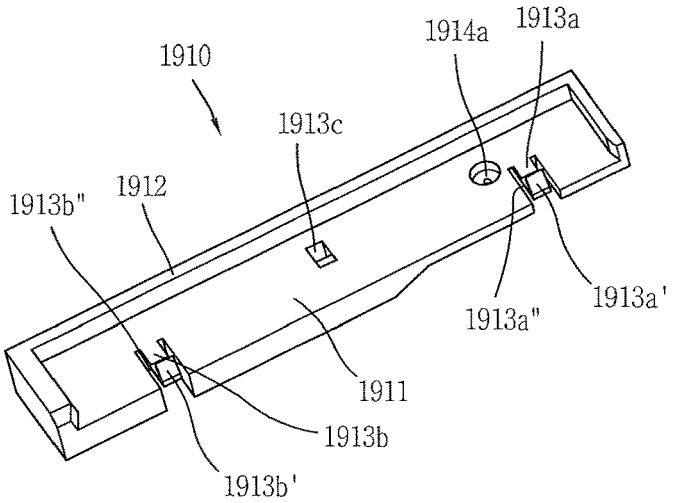
FIGS. 9A and 9B are diagrams illustrating an example upper bracket holder.
Figure 9B:
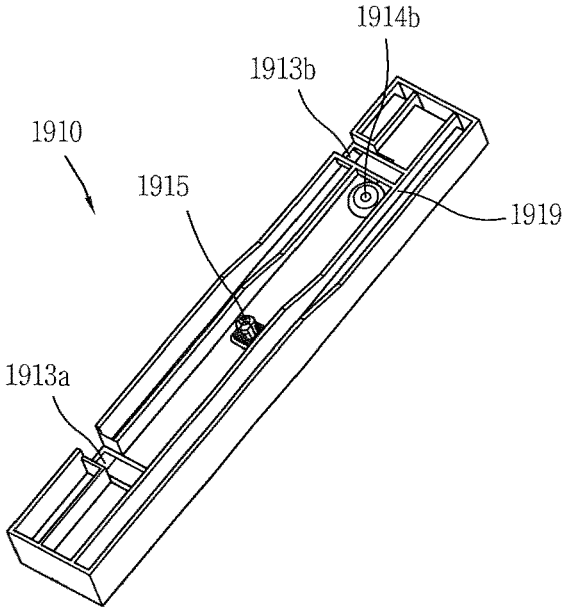

FIGS. 9A and 9B illustrate an example upper bracket holder. For example, the example upper bracket holder can be an upper bracket holder 1910. FIG. 9A illustrates one side of the upper bracket holder 1910 positioned to face the upper end of the bracket 1800 (see FIG. 8). FIG. 9B illustrates another side of the upper bracket holder 1910 positioned to face the upper wall of the inner casing 1120*a* and 1120*b* (see FIG. 1), 1120 (see FIGS. 3A and 3B), 2120 (see FIGS. 4A and 4B), and 3120 (see FIGS. 5A and 5B).

A bracket receiving portion 1911 is formed on one side of the upper bracket holder 1910. The bracket receiving portion 1911 is an area where the upper end of is the bracket 1800 is mounted.

A wall 1912 is formed around the bracket receiving portion 1911. There is a stepped portion between the wall 1912 and the bracket receiving portion 1911.

The bracket 1800 is inserted from the left or right side of the upper bracket holder 1910 and attached to the upper bracket holder 1910. The bracket 1800 is inserted from where hook attaching portions 1913*a* and 1913*b* are formed. The wall 1912 is formed around the bracket receiving portion 1911 so as to prevent the bracket 1800 from deviating from the bracket receiving portion 1911 by an excessive force that tries to attach the bracket 1800. However, the wall 1912 is not formed where the bracket 1800 is inserted from. The hook attaching portions 1913*a* and 1913*b* are formed where the bracket 1800 is inserted from. Ridges 1913*a*" and 1913*b*" are formed on the edges of the hook attaching portions 1913*a* and 1913*b*. With the ridges 1913*a*' and 1913*b*' being stuck on the bracket 1800, the bracket 1800 is kept from being arbitrarily removed from the upper bracket holder 1910.

Cut portions 1913" and 1913*b*" are formed on either side of the hook attaching portions 1913*a* and 1913*b*. With the cut portions 1913*a*" and 1913*b*", the hook attaching portions 1913*a* and 1913*b* may be partially pushed back by the bracket when the bracket 1800 is attached to the upper bracket holder 1910. Once the bracket 1800 is fully attached to the upper bracket holder 1910, the hook attaching portions 1913*a* and 1913*b* go back to the original position. Also, the hook attaching portions 1913*a* and 1913*b* are exposed to the other side of the upper bracket holder 1910.

A bracket insertion portion 1913*c* is formed on the bracket receiving portion 1911. The bracket insertion portion 1913*c* is a space that receives at least part of the bracket 1800. As the bracket 1800 is attached to the upper bracket holder 1910, is at least part of the bracket 1800 is inserted into the bracket insertion portion 1913*c*. The upper bracket holder 1910 may be hooked to the bracket 1800.

A fastening part insertion portion 1914*a* is formed on the bracket receiving portion 1911. The fastening insertion portion 1914*a* is in the form of a hole that opens to one side and the other side of the upper bracket holder 1910. A boss portion 1914*b* is formed on the other side of the upper bracket holder 1910, corresponding to the fastening part insertion portion 1914*a*. Fastening parts are for permanently fixing the upper bracket holder 1910. The boss portion 1914*b* is formed in such a way as to surround the fastening parts inserted into the fastening part insertion portion 1914*a*.

A deformation preventing portion 1919 is formed on the other side of the upper bracket holder 1910. The deformation preventing portion 1919 protrudes from the other side of the upper bracket holder 1910, and extends along the front-back direction. The front-back direction of the upper bracket holder 1910 refers to a direction corresponding to the front-back direction of the above-described bracket 1800. A plurality of deformation preventing portions 1919 may be provided and spaced at intervals.

The upper bracket holder 1910 is manufactured by injection molding, and injection-molded upper bracket holder 1910 might shrink or deform. However, as the deformation prevention portion 1919 connects all the way to the front and rear of the upper bracket holder 1910, the front and rear are supported by the deformation prevention portion 1919, thereby suppressing deformation.

A temporary fixing protrusion 1915 is formed on the other side of the upper bracket holder 1910. The upper wall of the inner casing 1120*a* and 1120*b*, 1120, 2120, and 3120 has a mounting recess 1121 (see FIGS. 3A and 3B, 2121 (see FIGS. 4A and 4B), and 3121 (see FIGS. 5A and 5B), corresponding to the temporary fixing protrusion 1915, and the temporary fixing protrusion 1915 protrudes from the other side of the upper bracket holder 1910 and is inserted into the mounting recess 1121, 2121, and 3121. The temporary fixing protrusion 1915 of the upper bracket holder 1910 consists of four segments. The temporary fixing protrusion 1915 may have any one of the structures explained with reference to FIGS. 3A to 5B.

Figure 10A:
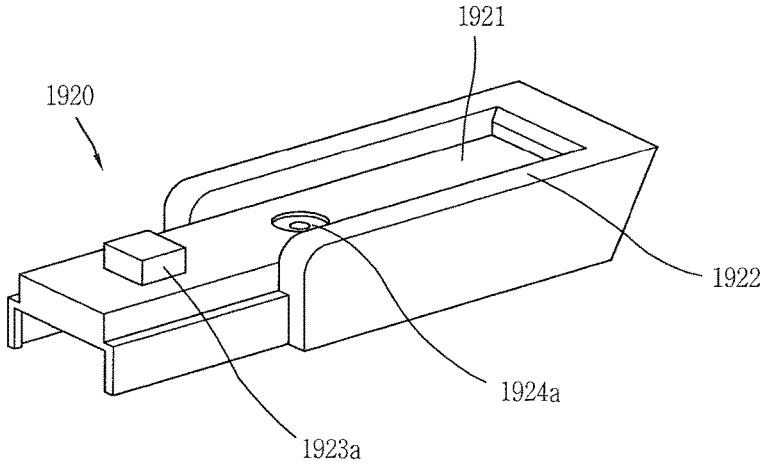
FIGS. 10A and 10B are diagrams illustrating an example lower bracket holder.
Figure 10B:
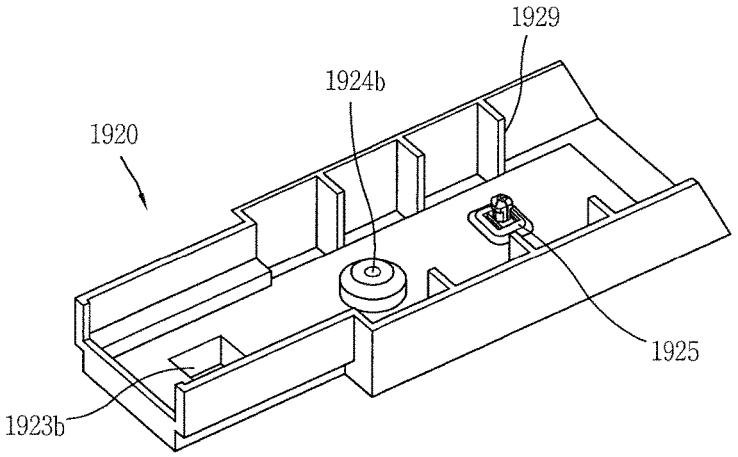

FIGS. 10A and 10B illustrate an example lower bracket holder. For example, the example lower bracket holder can be the lower bracket holder 1920. FIG. 10A illustrates one side of the lower bracket holder 1920 positioned to face the lower end of the bracket 1800 (see FIG. 8). FIG. 10B illustrates another side of the lower bracket holder 1920 positioned to face the base of the inner casing 1120*a* and 1120*b* (see FIG. 1), 1120 (see FIGS. 3A and 3B), 2120 (see FIGS. 4A and 4B), and 3120 (see FIGS. 5A and 5B).

A bracket receiving portion 1921 is formed on one side of the lower bracket holder 1920. The bracket receiving portion 1921 is an area where the upper end of the bracket 1800 is mounted.

A wall 1922 is formed around the bracket receiving portion 1921. There is a stepped portion between the wall 1922 and the bracket receiving portion 1921.

The bracket 1800 is placed on the lower bracket holder 1920 in a tilting position, and then inserted into the left or right side of the upper bracket holder 1910 (see FIGS. 9A and 9B) by an external force and attached to the upper bracket holder 1910 and the upper bracket holder 1910. Since the bracket 1800 is placed on the lower bracket holder 1920 in a tilting position, unlike it is placed on the upper bracket holder 1910, which is inserted from the side of the bracket 1800, the lower bracket, the wall 1922 may be formed on both the left and right sides of the bracket receiving portion 1921, and as shown in FIG. 10A, the wall 1922 may be formed on the rear of the bracket receiving portion 1921 as well.

A positioning projection 1923*a* protrudes from the bracket receiving portion 1921. A positioning recess corresponding to the positioning projection 1923*a* is formed on the lower end of the bracket 1800. When the positioning recess is placed in a position corresponding to the positioning projection 1923*a*, the bracket 1800 and the lower bracket holder 1920 may be attached together in their normal positions.

In some implementations, the lower bracket holder 1920 may have a U-shaped cross-section as shown in FIGS. 10A and 10B, but is not limited to it. However, the thicker an injection-molded part formed by injection molding, the more it can deform after the injection molding. The lower bracket holder 1920, too, which is formed by injection molding, can deform if the injection-molded part is thick. Thus, it is desirable that, in order to support the bottom of the bracket 1800, the lower bracket holder 1920 has a Π-shape by which the center is supported on both sides. For the same reason, it is desirable that a recess portion 1923*b* is formed on the other side of the lower bracket holder 1920, corresponding to the positioning projection 1923*a*.

A fastening part insertion portion 1924*a* is formed on the bracket receiving portion 1921. The fastening insertion portion 1924*a* is in the form of a hole that opens to one side and the other side of the lower bracket holder 1920. A boss portion 1924*b* is formed on the other side of the lower bracket holder 1920, corresponding to the fastening part insertion portion 1924*a*. The boss portion 1924*b* is formed in such a way as to surround the fastening parts inserted into the fastening part insertion portion 1924*a*.

A deformation preventing portion 1929 is formed on the other side of the lower bracket holder 1920. The deformation preventing portion 1929 protrudes from two opposite sides of the lower bracket holder 1920, and extends in the height direction of the lower bracket holder 1920. The two opposite sides of the lower bracket holder 1920 refer to the left and right sides of lower bracket holder 1920, and the other side of the lower bracket holder 1920 refers to the side facing the base of the inner casing 1120*a* and 1120*b*, 1120, 2120, and 3120, as shown in FIG. 10B. A plurality of deformation preventing portions 1929 may be provided and spaced at intervals.

The lower bracket holder 1920 is manufactured by injection molding, and injection-molded lower bracket holder 1920 might shrink or deform. However, as the deformation prevention portion 1929 extends in the height direction of the lower bracket holder 1920, the lower bracket holder 1920 is supported by the deformation prevention portion 1929, thereby suppressing deformation.

A temporary fixing protrusion 1925 is formed on the other side of the lower bracket holder 1920. The base of the inner casing 1120*a* and 1120*b*, 1120, 2120, and 3120 has a mounting recess 1121 (see FIGS. 3A and 3B, 2121 (see FIGS. 4A and 4B), and 3121 (see FIGS. 5A and 5B), corresponding to the temporary fixing protrusion 1925, and the temporary fixing protrusion 1925 protrudes from the other side of the lower bracket holder 1920 and is inserted into the mounting recess 1121, 2121, and 3121. The temporary fixing protrusion 1925 of the lower bracket holder 1920 consists of four segments. The temporary fixing protrusion 1925 may have any one of the structures explained with reference to FIGS. 3A to 5B.

The above-described refrigerator is not limited to the configurations and methods of the above-described examples, but such examples may be configured by a selective combination of all or part of the examples so as to implement many variations.

With the above-described configurations, an in-refrigerator part may be temporarily fixed by a temporary fixing protrusion and a mounting recess since the temporary fixing protrusion is inserted into the mounting recess and drawn together by the inner periphery of the mounting recess. Therefore, any hole on the inner casing or any sharp-pointed pin on the in-refrigerator part are not required for temporarily fixing the in-refrigerator part. This allows for temporarily fixing the in-refrigerator part to the food storage compartment without using a subsidiary material such as tape.

While the temporary fixing protrusion is not yet inserted into the mounting recess, the distance a between two contact points is longer than the distance b between two pressure points (a>b), and while the temporary fixing protrusion is not yet inserted into the mounting recess, the difference a−b between the distance a between the two contact points and the distance b between the two pressure points is smaller than the distance c between two segments of the temporary fixing protrusion (a−b<c). Thus, the mounting recess exerts external force on the temporary fixing protrusion, thereby allowing the in-refrigerator part to remain temporarily and stably fixed.

The first projection and the second projection each include a first portion spaced apart from the inner periphery of the mounting recess, a second portion having a larger circumference than the first portions, and a third portion configured to slope. Alternatively, the first projection and the second projection each include a first sloping portion whose cross-sectional area increase as it gets farther from the in-refrigerator part and a second sloping portion whose cross-sectional area decreases as it gets farther from the first sloping portion. Thus, the first and second projections may be inserted easily into the mounting recess and remain pressed by the mounting recess.

The mounting recess is recessed towards the outside of the food storage compartment, and exposed to the inside of the food storage compartment. The mounting recess is not a hole that opens to the inside and outside of the inner casing, and the perimeter of the mounting recess forms a boundary between the food storage compartment and insulation. Therefore, a liquid concentrate of insulation does not flow into the food storage compartment even if the inner casing has a mounting recess.

Accordingly, the present disclosure allows for temporarily fixing the in-refrigerator part to the food storage compartment without an additional process for blocking the hole in the inner casing by a subsidiary material such as tape.

The stepped portion formed on the inner periphery of the mounting recess and the bump on the temporary fixing protrusion can keep the in-refrigerator part temporarily fixed to the inner casing from arbitrary deviation. Moreover, the temporarily fixed in-refrigerator part can be released by applying external force in one direction because the stepped portion is formed only on one side of the mounting recess and the bump is formed only on one side of the temporary fixing protrusion.

What is claimed is:

1. A refrigerator comprising:

an inner casing that is located within a main refrigerator body and that includes:

a storage compartment, and a mounting recess that is a recessed portion on a surface of the inner casing; and an in-refrigerator part that is configured to be coupled to the inner casing and that includes:

a temporary fixing protrusion that protrudes from a portion of the in-refrigerator part and that includes two segments that are configured to (i) be inserted into the mounting recess, (ii) be coupled to an inner portion of the mounting recess, and (iii) be fixed to the mounting recess, wherein the mounting recess is formed by recessing at least a part of the inner casing toward an exterior area of a food storage compartment, and wherein the inner casing defines both a shape and a depth of the mounting recess.

2. The refrigerator of claim 1, wherein each of the two segments of the temporary fixing protrusion includes:

a respective contact portion that is configured to be coupled to the inner portion of the mounting recess, wherein the inner portion of the mounting recess includes:

two pressure portions, each of the two pressure portions being configured to press a respective contact portion of the two contact portions, and wherein the two contact portions are configured to become closer when the two segments of the temporary fixing protrusion are inserted into the mounting recess.

3. The refrigerator of claim 2, wherein, based on a determination of whether the two segments of the temporary fixing protrusion are inserted into the mounting recess, a first distance between the two contact portions is longer than a second distance between the two pressure portions.

4. The refrigerator of claim 2, wherein, based on a determination of whether the two segments of the temporary fixing protrusion are inserted into the mounting recess, a difference between a first distance and a second distance is smaller than a third distance between the two segments, and wherein the first distance indicates a distance between the two contact portions and the second distance indicates a distance between the two pressure portions.

5. The refrigerator of claim 1, wherein the two segments of the temporary fixing protrusion include:

a first projection, and a second projection that faces the first projection, and wherein each of the first projection and the second projection includes:

a respective first portion that protrudes from the in-refrigerator part and that is spaced apart from the inner portion of the mounting recess, a respective second portion that is pressed by the inner portion of the mounting recess, a circumference of the respective second portion is larger than a circumference of the respective first portion, and a respective third portion that includes a first side and a second side, wherein a circumference of the respective third portion at the first side is larger than a circumference of the respective third portion at the second side.

6. The refrigerator of claim 1, wherein the two segments of the temporary fixing protrusion include:

a first projection, and a second projection that faces the first projection, wherein each of the first projection and the second projection includes:

a respective first sloping portion that protrudes from the in-refrigerator part and that includes a first side and a second side, wherein a circumference of the respective first sloping portion at the first side is smaller than a circumference of the respective first sloping portion at the second side, and a respective second sloping portion that is coupled to the second side of the respective first sloping portion and that includes a third side and a fourth side, wherein a circumference of the respective second sloping portion at the third side is larger than a circumference of the respective second sloping portion at the fourth side, and wherein a respective boundary portion between the respective first sloping portion and the respective second sloping portion is configured to be pressed by the inner portion of the mounting recess.

7. The refrigerator of claim 1, wherein the in-refrigerator part includes:

a base portion that is configured to support the temporary fixing protrusion, and through holes that connect a first side of the base portion to a second side of the base portion.

8. The refrigerator of claim 1, further comprising:

an outer casing that encloses the inner casing, and an insulation layer that is coupled between the outer casing and the inner casing and that is configured to block heat transfer from the inner casing to the outer casing.

9. The refrigerator of claim 8, wherein the mounting recess is configured to separate the storage compartment from the insulation layer.

10. The refrigerator of claim 1, wherein the mounting recess includes:

a stepped portion that protrudes from a surface of the mounting recess, and wherein the temporary fixing protrusion includes:

a bump that protrudes from the temporary fixing protrusion, and wherein the stepped portion is coupled to the bump when the temporary fixing protrusion is inserted into the mounting recess.

11. The refrigerator of claim 1, further comprising:

a drawer that is configured to store food and that is moveable between a first position and a second position, the drawer being inside the storage compartment at the first position and a part of the drawer being outside the storage compartment at the second position, wherein the in-refrigerator part includes:

a sliding rail that is coupled to the inner casing and that is configured to guide the drawer.

12. The refrigerator of claim 11, wherein the sliding rail is coupled to a first of the drawer and includes a first temporary fixing protrusion that is configured to temporarily fix the sliding rail to the inner casing.

13. The refrigerator of claim 1, further comprising:

a vertical bar; and a bracket that couples the vertical bar to a surface of the inner casing and that is configured to divide the storage compartment into a first interior area and a second interior area, wherein the in-refrigerator part includes:

bracket holders (i) that couple the bracket to the inner casing and (ii) that are configured to support the bracket, each of the bracket holders including a respective second temporary fixing protrusion that is configured to temporarily fix each of the bracket holders to the inner casing.

14. The refrigerator of claim 11, wherein the inner casing includes a hook portion that protrudes from a surface of the inner casing, and wherein the sliding rail includes a hook insertion portion that is configured to be coupled to the hook portion such that the sliding rail is fixed to the inner casing.

15. The refrigerator of claim 11, wherein the sliding rail includes a plurality of fastening part insertion portions, each fastening part insertion portion comprising a hole through which a fastening part passes to fix the sliding rail to the inner casing.

16. The refrigerator of claim 13, wherein at least one of the bracket holders includes a plurality of hook attaching portions from which the bracket is inserted.

17. The refrigerator of claim 16, wherein each of the hook attaching portions includes a ridge portion that is configured to be stuck on the bracket such that the bracket is fixed to the at least one of the bracket holders.

18. The refrigerator of claim 17, wherein each of the hook attaching portions further includes a first cut portion that is formed at a first side of the hook attaching portion and a second cut portion that is formed at a second side of the hook attaching portion.

19. The refrigerator of claim 13, wherein at least one of the bracket holders includes a positioning projection that protrudes from a surface of the at least one of the bracket holders, and wherein the bracket includes a positioning recess that is configured to be coupled to the positioning projection.

20. The refrigerator of claim 13, wherein at least one of the bracket holders includes a fastening part insertion portion comprising a hole through which a fastening part passes to fix the at least one of the bracket holders to the bracket.

* * * * *